United States Patent [19]

Ozaki et al.

[11] 4,021,108

[45] May 3, 1977

[54] ELECTROPHOTOGRAPHIC COPYING APPARATUS

[75] Inventors: Yoshihiro Ozaki, Isehara; Takao Saijo, Mitaka; Kenjiro Ishii, Yokohama; Yasukuni Omata, Hachioji; Shoji Kondo, Tokyo, all of Japan

[73] Assignee: Minolta Camera Kabushiki Kaisha, Osaka, Japan

[22] Filed: Sept. 22, 1975

[21] Appl. No.: 615,708

[30] Foreign Application Priority Data

| | | |
|---|---|---|
| Oct. 2, 1974 | Japan | 49-119593[U] |
| Oct. 15, 1974 | Japan | 49-124823[U] |
| Nov. 13, 1974 | Japan | 49-137947[U] |
| Dec. 19, 1974 | Japan | 49-155319[U] |
| Feb. 3, 1975 | Japan | 50-14630 |
| Feb. 4, 1975 | Japan | 50-16644[U] |

[52] U.S. Cl. ..... 355/3 R

[51] Int. Cl.[2] ..... G03G 15/044

[58] Field of Search ..... 355/3 R, 3 TE, 76, 16; 354/3

[56] References Cited

UNITED STATES PATENTS

| | | | |
|---|---|---|---|
| 3,499,709 | 3/1970 | Uhlenberg | 355/3 TE |
| 3,711,197 | 1/1973 | Paull | 355/16 |
| 3,715,156 | 2/1973 | Levy | 355/16 |

*Primary Examiner*—L. T. Hix
*Assistant Examiner*—Kenneth C. Hutchison
*Attorney, Agent, or Firm*—Wenderoth, Lind & Ponack

[57] ABSTRACT

In an electrophotographic copying apparatus of a type in which an electrostatic latent image of an original to be copied is formed, through suitable illumination means, on a dielectric surface of a transfer material or copy paper held under pressure between a photoreceptor plate and an electrically conductive pressure pad on a pressing plate during impression of a potential across the photoreceptor plate and the pressure pad, there are incorporated an improved pressing device for pressing the copy paper against the photoreceptor plate, and a fixing device having uniform heat radiation and operated through a special fixing temperature control circuit.

6 Claims, 22 Drawing Figures

ELECTROPHOTOGRAPHIC COPYING APPARATUS

The present invention relates to an electrophotographic copying apparatus and, more particularly, to an electrophotographic copying apparatus of a type, for example, equipped with a micro film reader, in which an electrostatic latent image of an original to be copied is formed, through suitable illumination means, on a dielectric surface of a transfer material or copy paper sheet held under pressure between a photoreceptor plate composed of a photoconductive layer formed on a light transmitting electrode plate and a pressing electrode plate, with a predetermined voltage impressed between the photoconductive plate and the pressing electrode plate during exposure of the photoreceptor plate to a light image of an original to be copied.

Commonly, in the electrophotographic copying apparatus of the above described type, there is provided a pressing electrode plate having a conductive elastic pressure pad thereon and selectively pressed against or released from the photoconductive surface of a photoreceptor plate secured to a frame of the apparatus, the pressing electrode plate being adapted to be pressed against the photoreceptor plate, with the transfer material or copy paper sheet fed therebetween by suitable means, while a predetermined potential is impressed across the photoreceptor plate and the pressure pad of the pressing electrode plate, and after removal of the applied potential, the electrode plate is released from the photoreceptor plate with simultaneous transportation of the copy paper sheet to a developing device for developing the latent image formed on the copy paper sheet.

Accordingly, it is necessary for the copying apparatus of the above described type to be provided with means for selectively, repeatedly pressing the electrode plate and consequently the pressure against or releasing the same from the photoreceptor plate with a space kept therebetween during absence of the impressed voltage so as to permit the copy paper sheet to pass therethrough. Additionally, in the state where the electrode plate and the pressure pad is pressed against the photoreceptor plate, electrostatic transfer of the image to be copied is effected from the photoreceptor plate to the copy paper sheet through exposure of the photoreceptor to a light image of the original and the voltage impression between the photoreceptor plate and the electrode plate, so that the degree of close contact between the photoreceptor plate and the copy paper sheet and also the pressure pad of the pressing electrode plate influences the quality of the copied image to a great extent, although the exposure is not limited at the time when the electrode plate is being pressed against the photoreceptor plate, and consequently the life of the photoreceptor plate tends to be shortened, if the surface of the photoreceptor plate is damaged by the copy paper sheet or the electrode plate or subjected to an excessive pressure during pressing of the electrode plate against the photoreceptor plate. The copying apparatus is also required to be equipped with means for releasing the electrode plate from the photoreceptor plate whenever paper jamming or the like troubles should occur. Moreover, the means for pressing the electrode plate against the photoreceptor should be so arranged that the both plates contact each other under uniform pressure without forming any bubbles of air therebetween.

In order to meet the requirements as described above, there has conventionally been proposed pressing means such as in the so called Varian device disclosed in the U.S. Pat. No. 3,715,156 wherein the pressing electrode plate suitably associated in its movement with the transfer of the copy paper sheet and the voltage impression is provided for repeatedly being pressed against or released from the photoreceptor plate with the surface of the pressing electrode plate facing the corresponding surface of the photoreceptor plate being suitably covered with a conductive porous elastic pressure pad. Such conventional pressing means is broadly divided into two kinds, in one of which kinds, the pressing electrode plate having the elastic pad thereon is adapted to move in a direction parallel to the stationary photoreceptor plate for pressing the whole surface of the electrode plate against the surface of the latter at one stroke, while in the other kind, the pressure electrode plate pivotally supported at one edge thereof on a frame of the apparatus is gradually pressed against the photoreceptor surface through the conductive pressure pad as the electrode plate pivots about the pivotal point. In the former kind, however, air bubbles tend to be formed between the photoreceptor plate and the electrode plate, thus hindering perfect electrostatic transfer at the air bubble containing portion, while in the latter kind, although the arrangement for the conductive pad surface of the electrode plate to gradually come into contact with the photoreceptor surface slantwise is effective for removing air bubbles and for close contact among the photoreceptor, copy paper sheet and electrode plate, slippage between the copy paper sheet and the photoreceptor plate tends to occur due to compression of the conductive elastic pressure pad, resulting in damage to the photoreceptor surface and consequent short life of the photoreceptor plate. In the former kind of pressing means, it is proposed to provide the pad surface with a curvature for removing air bubbles during pressing, which arrangement however, also has a disadvantage in that the pressure toward the photoreceptor is not uniformly applied. Furthermore, the driving means for the pressing means of the former kind is required to press the electrode plate against the photoreceptor plate sufficiently tightly for impressing the voltage therebetween for a predetermined period of time, while the same must be so designed, in releasing the electrode plate from the photoreceptor, as to maintain enough clearance and sufficient time for the copy paper sheet to pass between the photoreceptor plate and the pressing electrode plate, which mechanism is rather complicated in construction, presenting various problems from the manufacturing point of view.

Furthermore, in the latent image transfer type copying apparatus wherein a transfer material or copy paper sheet the surface of is coated with an insulating layer is employed, unlike an electrophotographic copying apparatus using a zinc oxide copy paper sheet the surface of which is of a porous nature, various disadvantages are inherent, such as toner particles forming toner powder image on the copy paper sheet tend to be disturbed or scattered by the liquid turbulence during fixing in a fixing device or the toner particles come off the surface of the copy paper sheet which is merely heated and dried as the toner powder image formed portion thereof is subjected to friction during transportation of the copy paper sheet within the apparatus, since the degree of impregnation or adhesion of such toner particles to the copy paper sheet is small, depending on the material of the insulating layer of the copy paper sheet. In order to overcome such problems encountered in the latent image transfer type electrophotographic copying apparatus, there has been proposed a method wherein the copy paper sheet is sufficiently heated during passage thereof between a pair of heat rollers in the fixing device, after developing solution absorbed in the surface of the copy paper sheet has been squeezed out to a certain extent by a pair of squeeze rollers or the like, which method, however, still has a disadvantage that, since a liquid film containing a small amount of toner therein is formed on the surface of the copy paper sheet, disorder or disturbance of the fixed image may result due to unbalanced heat radiation through rapid heating of the copy paper surface by the heat rollers having a high temperature.

Another disadvantage inherent in the fixing device of the above described type is that such fixing device is required to be preliminarily heated constantly since the temperature thereof is not raised to a level ready for fixing upon starting of the copying apparatus, by which arrangement, an appreciable amount of electric power is needlessly consumed. Conventionally, there has been proposed a fixing device wherein a main heater and an auxiliary heater are simultaneously energized upon starting of the copying apparatus, with the period of time for the fixing device to reach a predetermined temperature being preset, and the auxiliary heater is de-energized after the preset period of time, for maintaining the predetermined temperature only through the main heater, which proposed fixing device, however, also has disadvantages such as that, since the period of time in which the fixing device reaches the predetermined temperature is preset by a timer or the like, the period of time preset is not related to ambient temperatures or to differences in atmospheric temperatures, for example, to those in summer and winter, and presents various inconveniences such that the auxiliary heater is de-energized before the fixing device reaches the predetermined temperature level even in winter when the atmospheric temperature is low, thus making it necessary to raise the temperature of the fixing device only by the main heater and consequently requiring a longer period of time for the fixing device to reach the temperature ready for fixing, while even in the summer time in which the atmospheric temperature is high, the auxiliary heater preset by the timer is kept energized even after the temperature of the fixing device has reached the predetermined temperature level, thus resulting in over-heating of the fixing device, consequent faulty fixing, offset in the heat rollers or burning of the copy paper sheet in the worst case.

Moreover, in the copying apparatus of the above described type in which a micro film reader is further incorporated for projecting a micro film image onto a screen plate disposed in a front portion of the apparatus and also for transferring the same micro film image onto the transfer material or copy paper sheet, and in which similar exposure, developing and fixing processes to those in the foregoing description are employed as in the so-called Electro-Fax system, it is necessary to effect a reverse development employing a special developing agent for obtaining a positive transferred image on the copy paper sheet from a negative micro film, since the Electro-Fax system is designed to obtain a positive image from a positive original to be copied, in which reverse development, however, not only is the transferred image inferior in quality, but the copying apparatus itself tends to have a large size, requiring a space for a separate charging station or the like. Additionally, since the copy paper must be fed to the image forming portion from the copy paper storage portion upon starting of the copying operation, the copying speed is undesirably retarded. Furthermore, when the copying apparatus equipped with the micro film reader as described above is used exclusively as a micro film reader, the light image of the micro film illuminated by a light source has to be reflected through an optical system including a plurality of reflecting mirrors for the projection of the light image onto the screen plate, while when the same is used as a copying apparatus, the reflecting mirrors must be removed from the path of light for projecting the light image from the micro film onto the surface of the photoreceptor, in which arrangement, driving means for removing the reflecting mirrors from the light path is inevitably required, thus not only complicating the construction of the copying apparatus, but giving rise to noises during operations. Another disadvantage of the copying apparatus of the above described type is that it is impossible to enable the copying apparatus to function as a micro film reader and copying apparatus simultaneously.

Accordingly, an essential object of the present invention is to provide an electrophotographic copying apparatus of a type wherein a latent image is formed on transfer material of insulating nature held under pressure between a photoreceptor plate and an electrode plate with a voltage being impressed therebetween during exposure of the photoreceptor plate to a light image of an original to be copied, which copying apparatus is equipped with a pressing device for transfer material, having a pressing electrode plate to be pressed against the surface of a photoreceptor under uniform pressure without forming bubbles of air between the photoreceptor and the pressure electrode plate or damaging the photoreceptor surface.

Another important object of the present invention is to provide an electrophotographic copying apparatus of the above described type in which the pressing device for the transfer material is associated, in the functioning of the pressing electrode plate thereof, with the copying operations.

A further object of the present invention is to provide an electrophotographic copying apparatus of the above described type which is equipped with a fixing device without unbalanced heat radiation for preventing disorder or disturbance of the copied image.

A still further object of the present invention is to provide an electrophotographic copying apparatus of the above described type having a fixing device which rapidly reaches a predetermined temperature level ready for fixing without temperature deviations from the preset temperature level irrespective of atmospheric temperatures.

Another object of the present invention is to provide an electrophotographic copying apparatus of the above described type having a micro film reading device of simple construction incorporated therein for simultaneous projection of a light image of a micro film onto a screen plate for observation and onto the photoreceptor surface for reproducing the same image on the transfer material.

According to a preferred embodiment of the present invention, the electrophotographic copying apparatus is provided with a pressing device for pressing the copy paper sheet against the photoreceptor surface and releasing the same therefrom which includes a pressing electrode plate pivotally connected at one edge portion thereof to a frame of the apparatus in a position below a photoreceptor plate and having a conductive elastic pressure pad on the surface thereof facing the corresponding surface of the photoreceptor, with the pressing electrode plate being adapted, through a suitable driving means, to rotate about the pivotal point for pressing the copy paper sheet inserted between the photoreceptor plate and the electrode plate against the photoreceptor plate through the conductive elastic pad, while a voltage is impressed between a photoconductive layer of the photoreceptor plate and the electrode plate, in which arrangement, since the pivotal point for the electrode plate is disposed in a position where the extension of the surface of the photoreceptor plate and the extension of the compressed surface of the conductive elastic pad intersect each other, the entire surfaces of the photoreceptor plate and the copy paper sheet are uniformly pressed against the conductive pad of the pressing electrode plate without the possibility of containing air therebetween and with minimum slippage between the copy paper sheet and the photoreceptor plate due to compression of the conductive pad, any damage to the photoreceptor surface arising from the friction due to the slippage thereby being advantageously prevented. For pivoting the electrode plate about the pivotal point thereof toward the photoreceptor plate or away from the same, the electrode plate is further associated with a driving device in the form either of a slider crank mechanism or a simple cam drive mechanism which is in turn associated with the copying operations of the apparatus, so that the conductive elastic pad of the electrode plate is uniformly pressed against the photoreceptor surface under sufficient pressure, with the copy paper sheet tightly held therebetween especially when the voltage is being impressed between the photoreceptor plate and the electrode plate, while, during transportation of the copy paper sheet, the pressing electrode plate is spaced away from the photoreceptor for a sufficient period of time with ample clearance kept therebetween for permitting the copy paper sheet to pass therethrough, thus the construction of the driving device is remarkably simplified with accurate functioning.

Furthermore, in the copying apparatus of the invention, there is provided an improved fixing device having a compact construction which includes a fixing roller and a heat roller, with brush bristles of heat-resistant material being fixed on the outer periphery of the fixing roller for improved heat radiation and less friction with respect to the toner image formed on the copy paper sheet, so that disorder or disturbance of the transferred image configuration can be eliminated. The fixing device is further provided with a fixing temperature control circuit which comprises a main heater provided with a control circuit for controlling the power supply thereto and an auxiliary heater having a thermoswitch for de-energizing the same when the temperature within the fixng device has reached a predetermined level, by which arrangement, not only does the temperature within the fixing device rapidly rise to the preset level irrespective of the atmospheric temperatures, but the same is stably maintained at the predetermined level with substantial elimination of the disadvantages inherent in the conventional fixing devices.

These and other objects and features of the present invention will become apparent from the following description taken in conjunction with the preferred embodiment thereof with reference to the accompanying drawings, in which.

Figure 2:
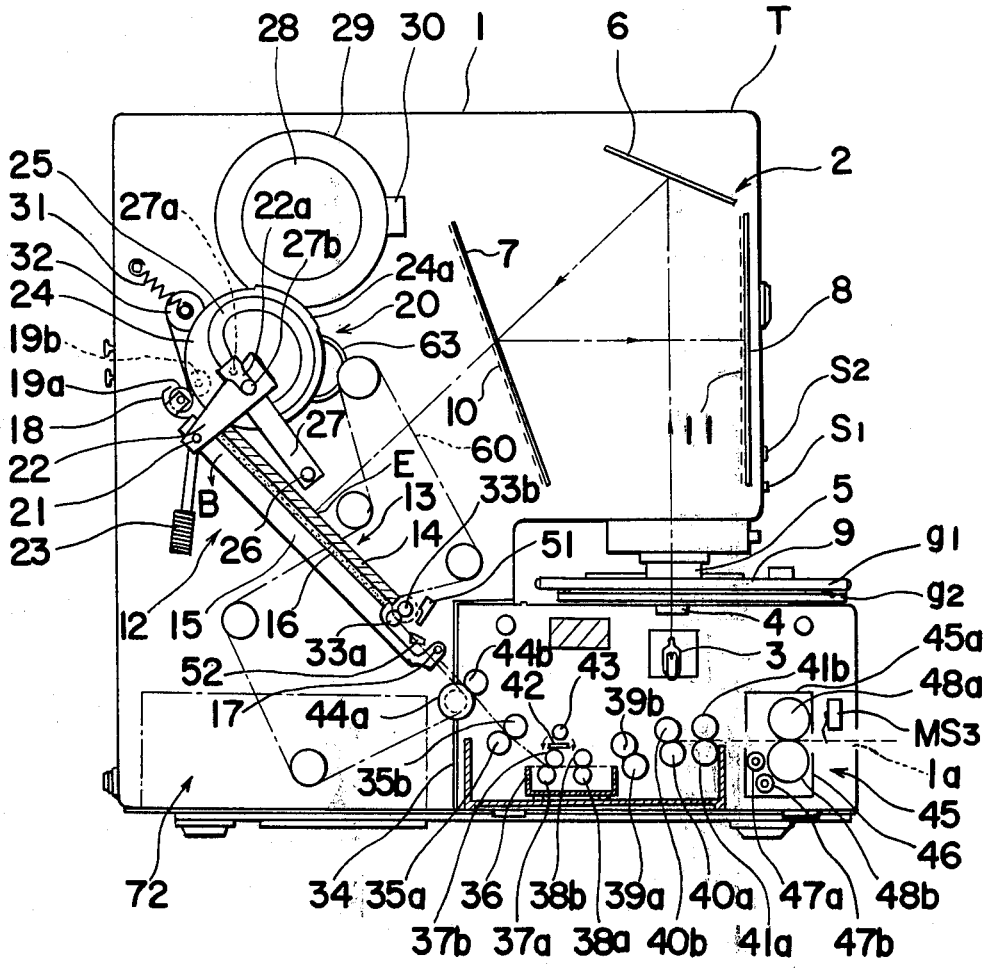
FIG. 2 is a schematic cross sectional view of the electrophotographic copying apparatus of FIG. 1.
Figure 4:
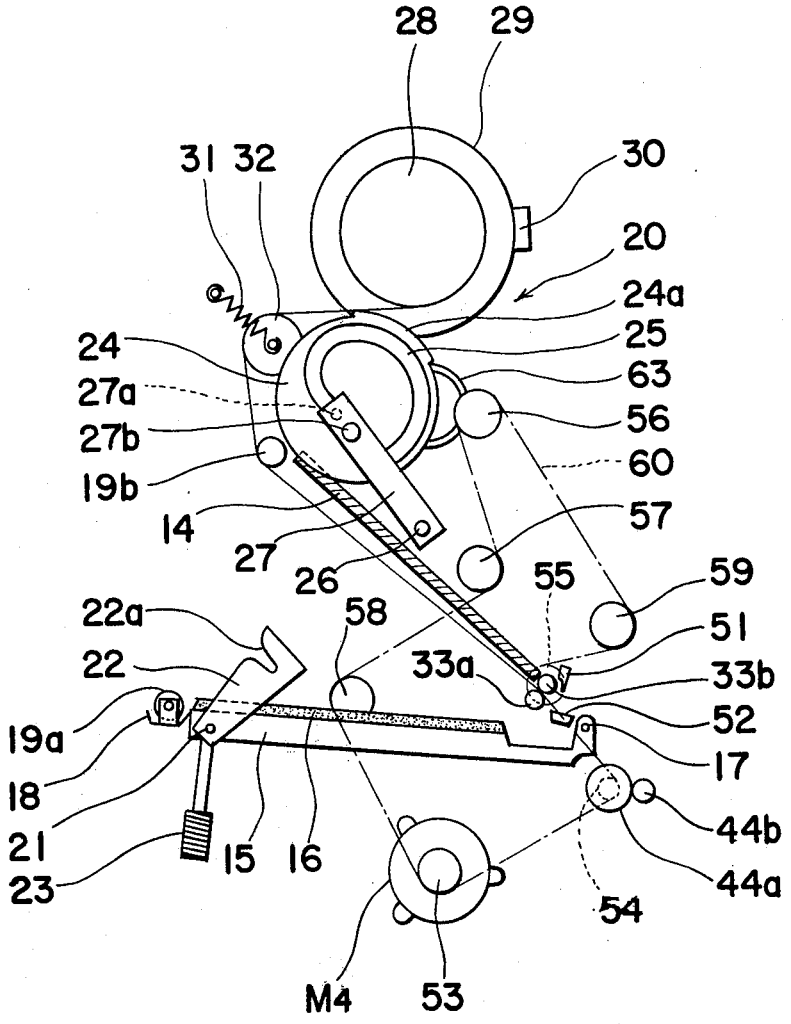
FIGS. 4 and 5 are schematic views showing, on an enlarged scale, construction of a pressing control device for the transfer material pressing device and mechanisms associated therewith.
Figure 5:
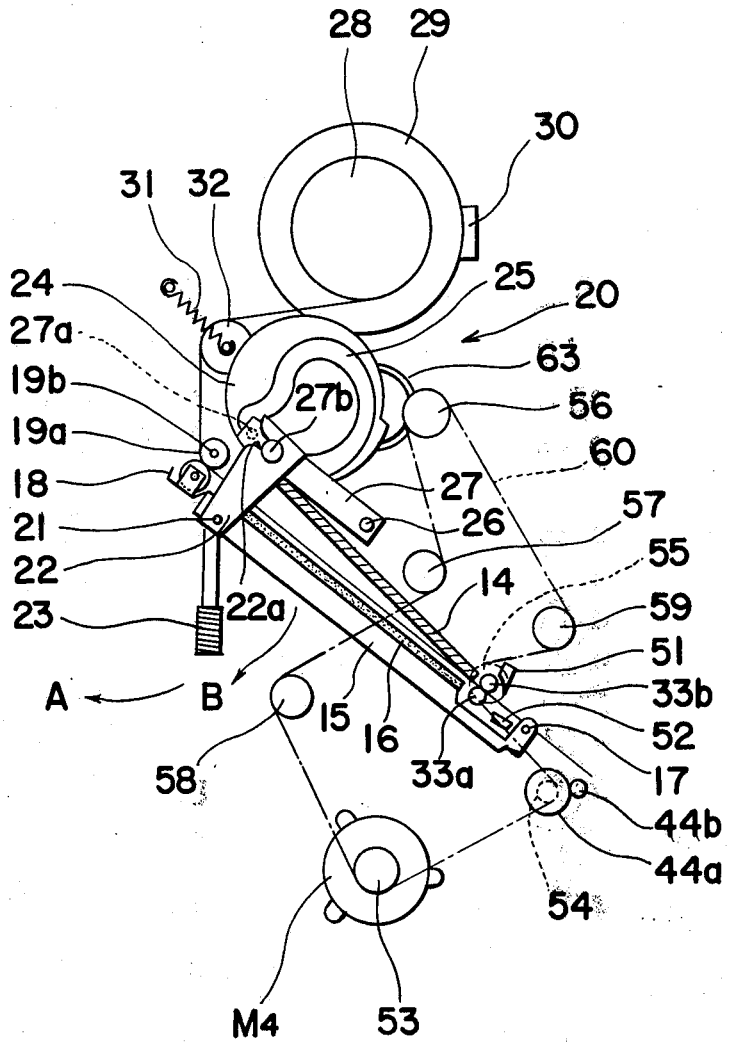
Figure 7:
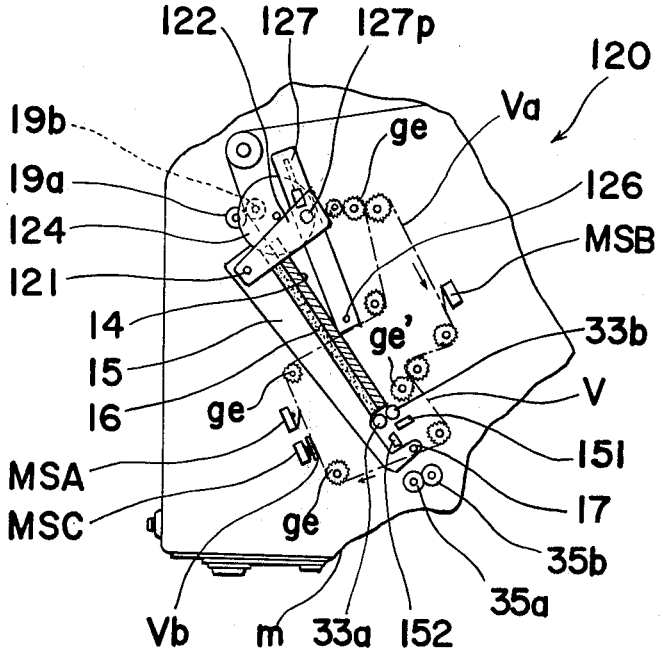
FIG. 7 is a similar view of FIGS. 4 and 5, but particularly shows a modification thereof.
Figure 8:
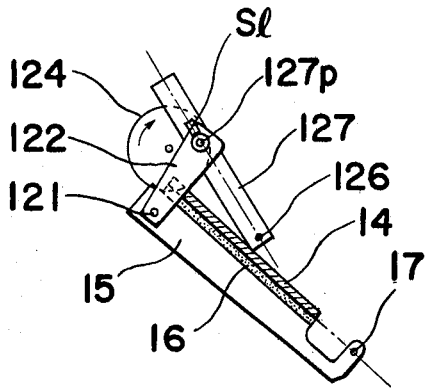
Figure 8:
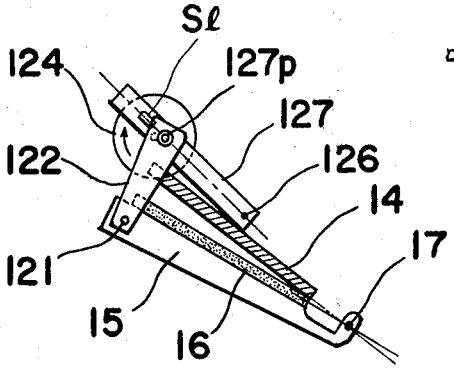
Figure 8:
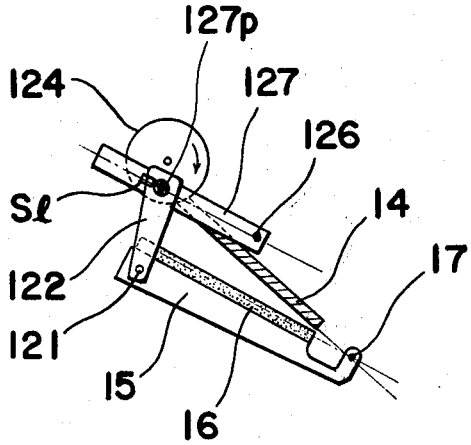
Figure 9:
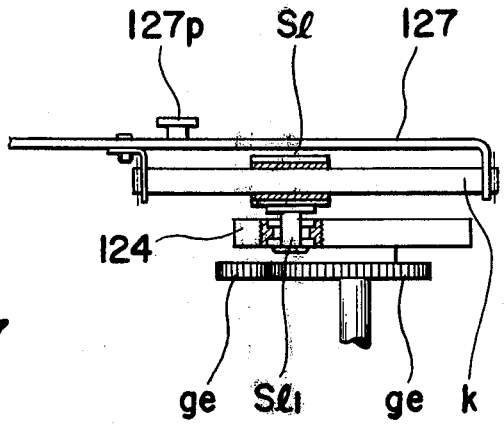
Figure 10:
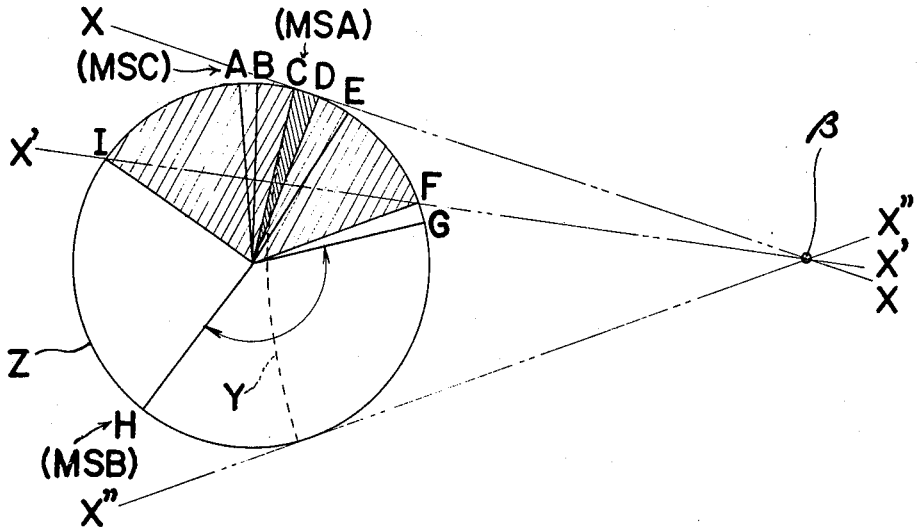
Figure 11:
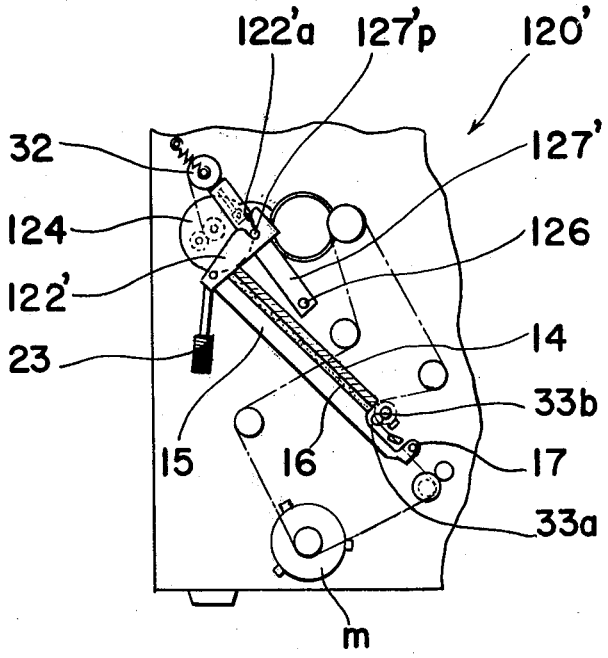
Figure 12:
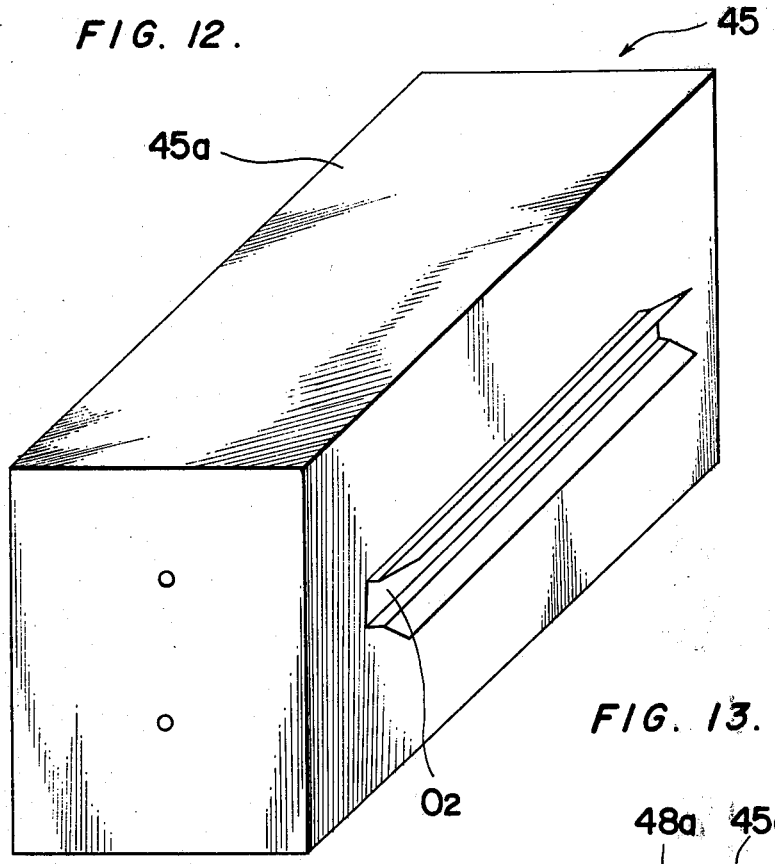
Figure 13:
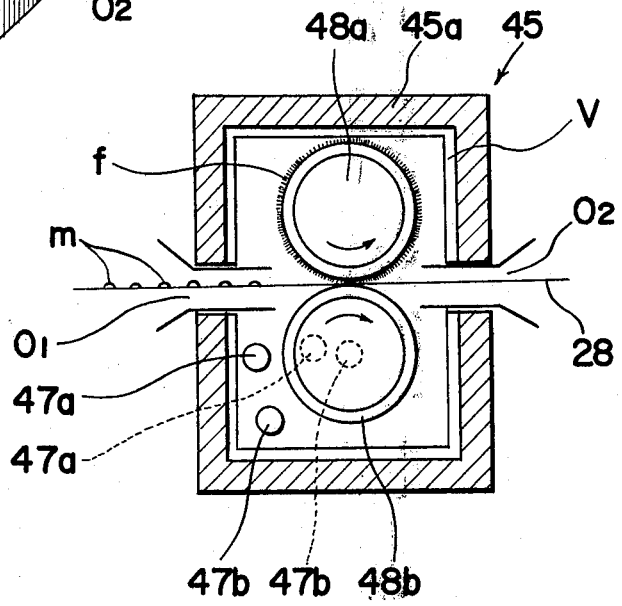
Figure 14:
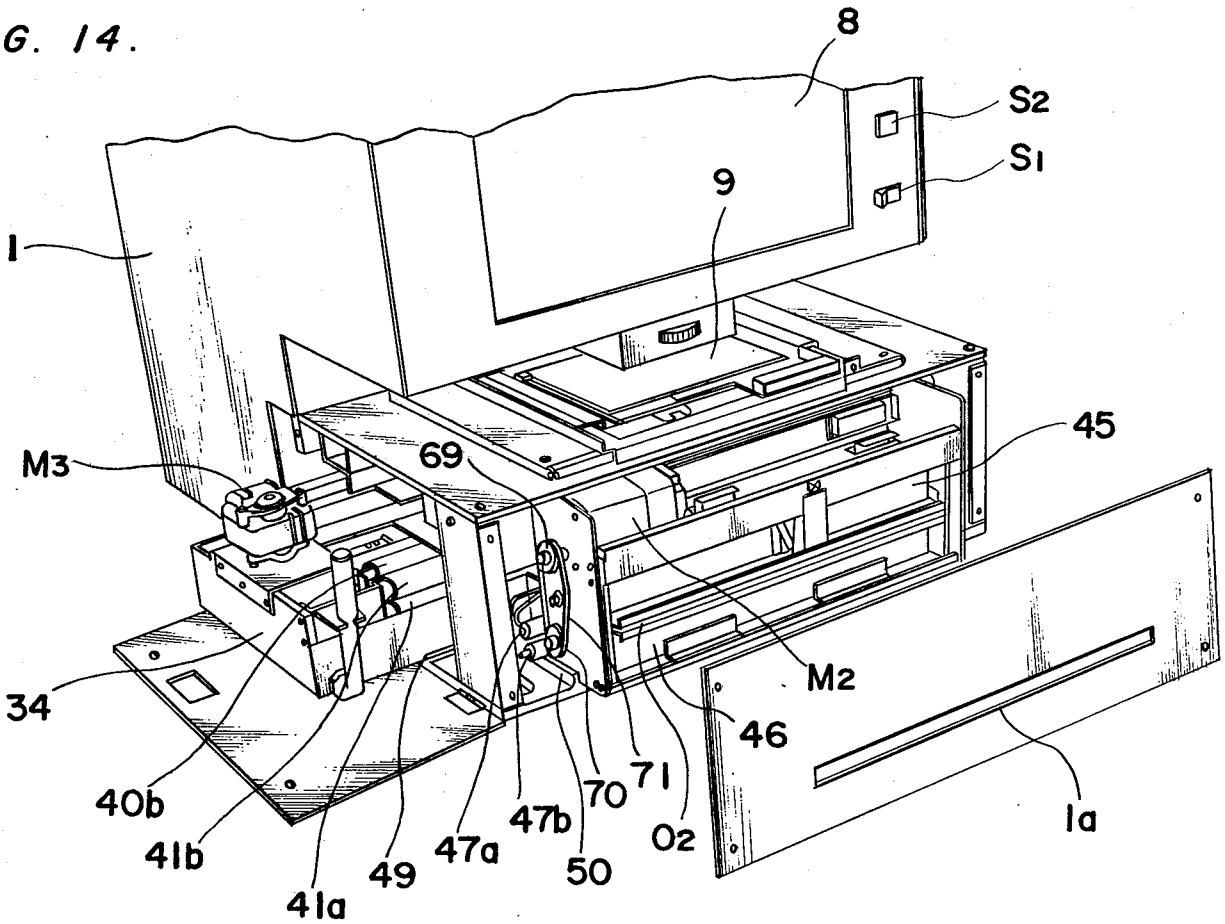
Figure 15:
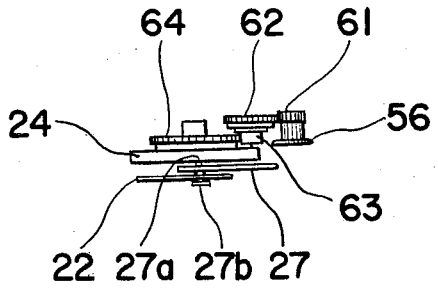
Figure 16:
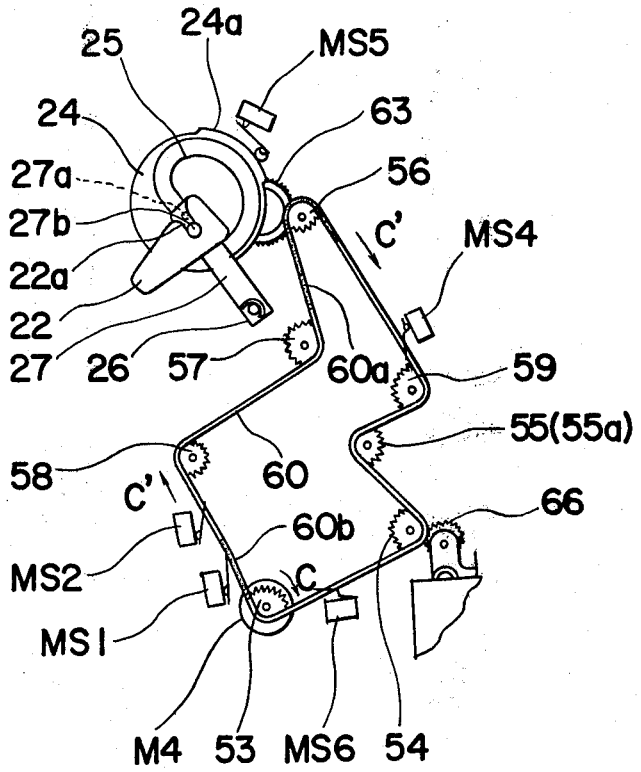
Figure 17:
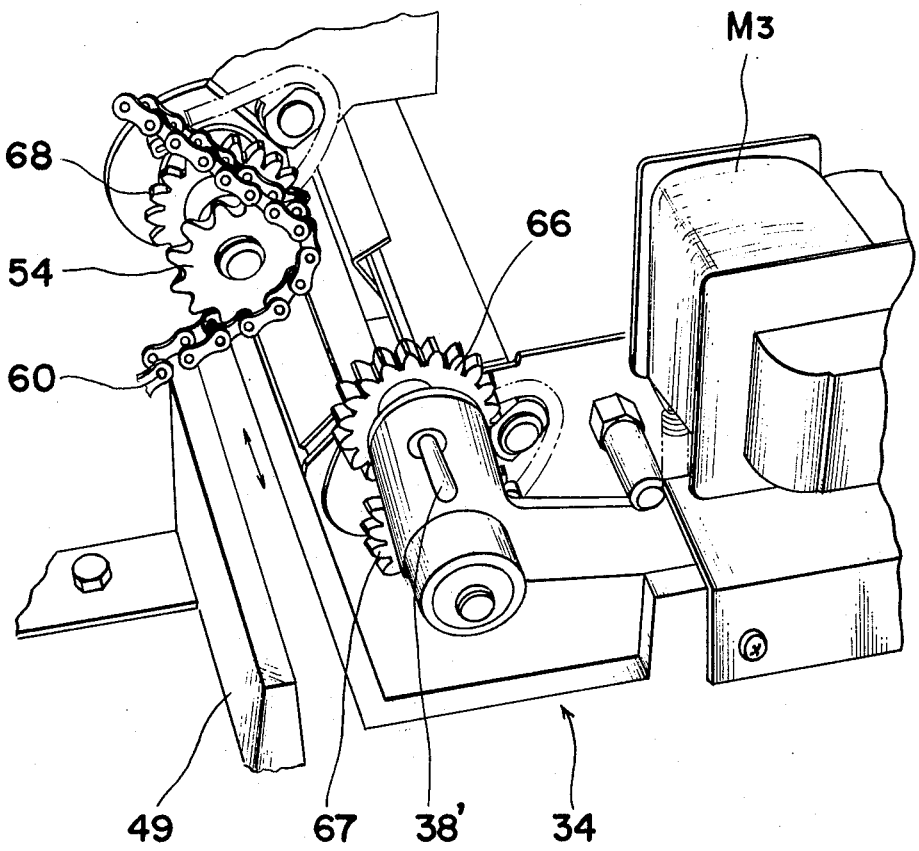
Figure 18:
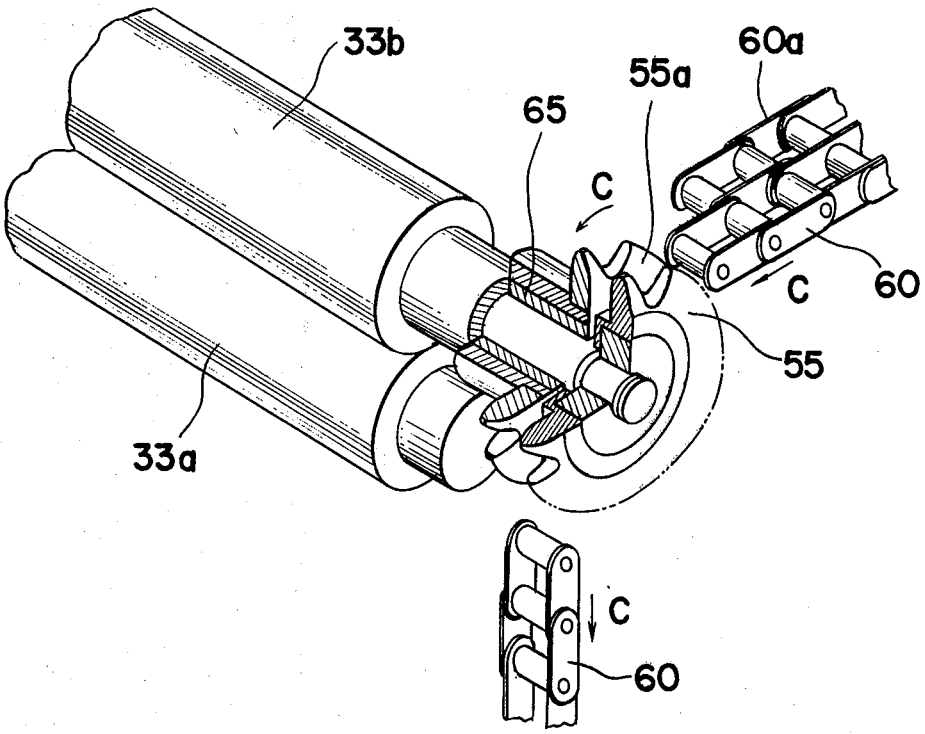
Figure 20:
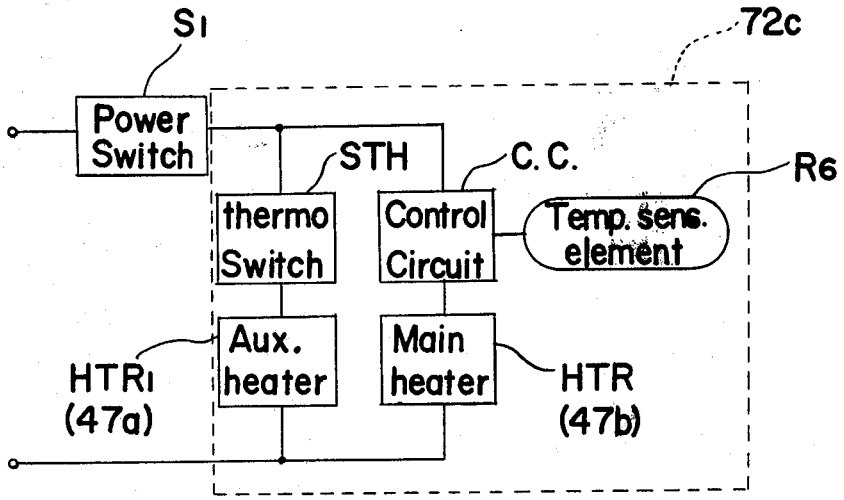
Figure 19:
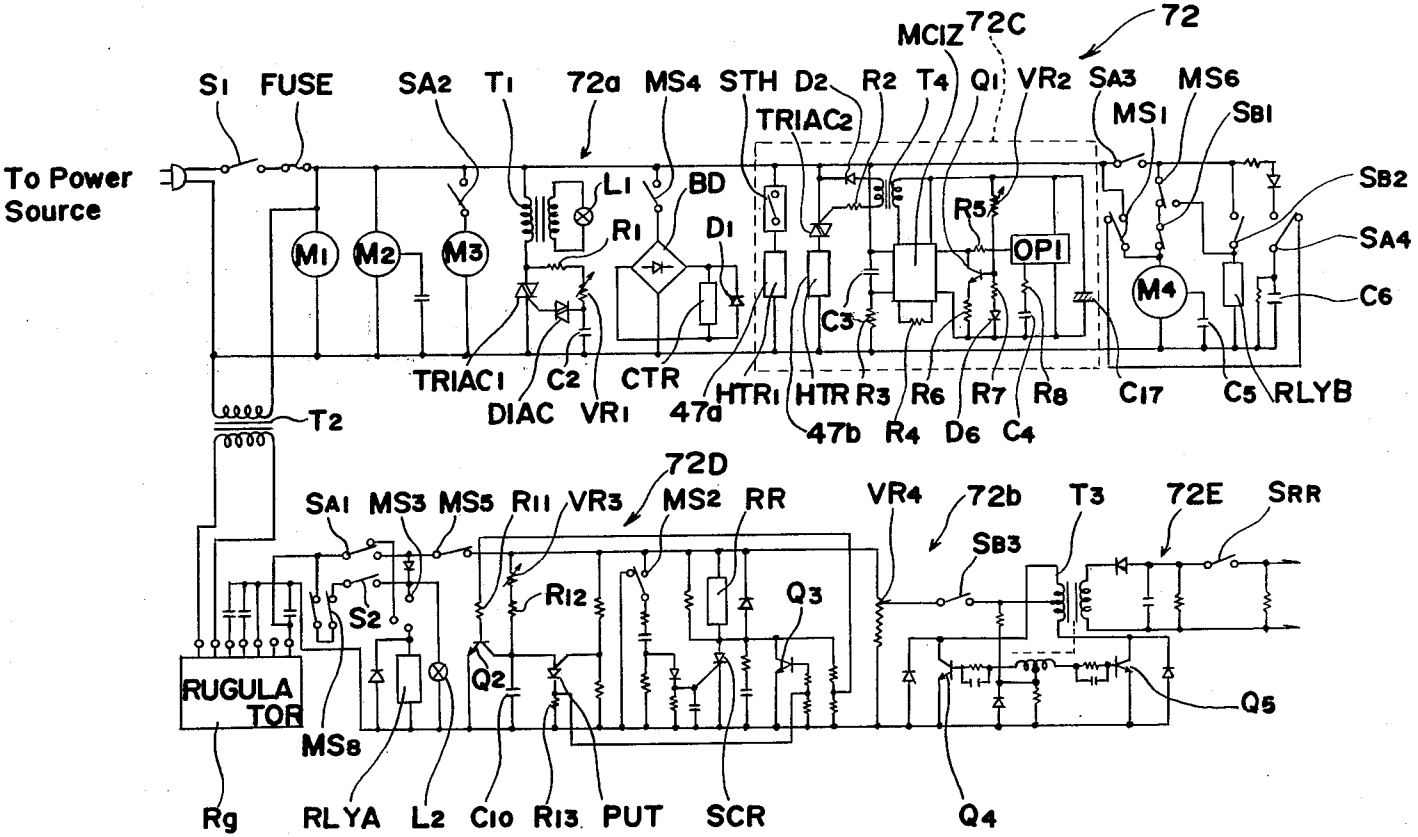

FIGS. 8(*a*) to 8(*c*) are schematic views showing the sequence of operations of the modification of FIG. 7;

FIG. 9 is a cross sectional view showing on an enlarged scale, construction of a rocking member, a slider member and mechanisms associated therewith employed in the modification of FIG. 7;

FIG. 10 is a diagram showing the relation between the movements of a pressure plate employed in the modification of FIG. 7 and operations of the copying apparatus;

FIG. 11 is a similar view to FIG. 7, but particularly shows another modification thereof;

FIG. 12 is a perspective view, on an enlarged scale, of a fixing device employed in the apparatus of FIG. 2;

FIG. 13 is a cross sectional view of the fixing device of FIG. 12;

FIG. 14 is a perspective view showing, on an enlarged scale, the arrangement of a developing device and the fixing device incorporated in the apparatus of FIG. 2, with part of side walls and front wall thereof removed for clarity;

FIGS. 15 and 16 are schematic views showing, on an enlarged scale, a driving system for the device of FIGS. 4 and 5;

FIGS. 17 and 18 are perspective views showing, on an enlarged scale important portions of a driving system for the developing device and feeding rollers employed in the apparatus of FIG. 2;

FIG. 19 is an electrical circuit diagram illustrating connections of various elements of the copying apparatus according to the present invention; and FIG. 20 is an electrical diagram particularly showing construction of a fixing temperature control circuit incorporated in the circuit of FIG. 19.

Before the description of the present invention proceeds, it is to be noted that like parts are designated by like reference numerals throughout several views of the attached drawings.

Figure 1:
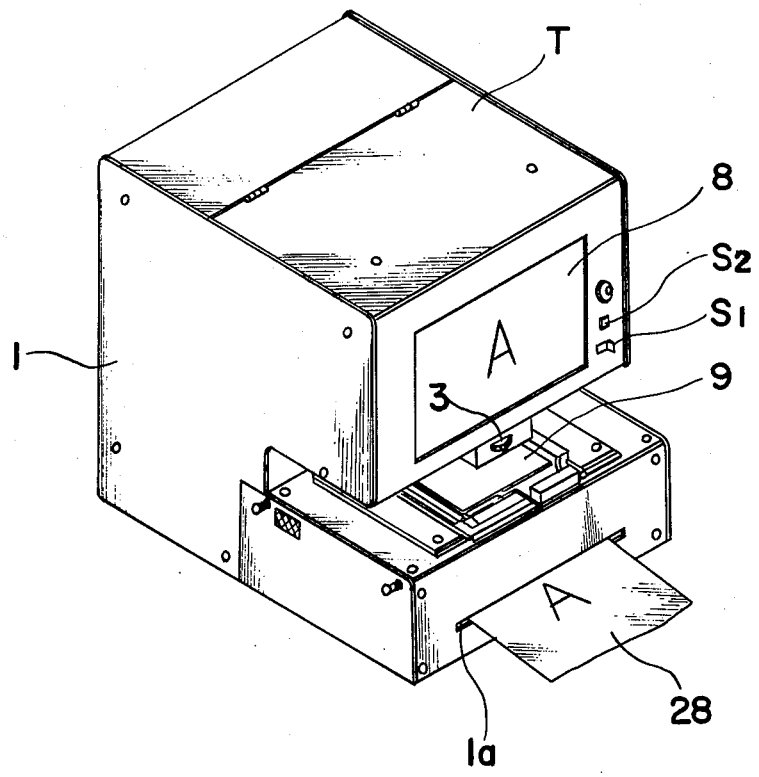
FIG. 1 is a perspective view of an electrophotographic copying apparatus in which a micro film reader is incorporated.

Referring to FIGS. 1 and 2, there is shown an electrophotographic copying apparatus T combined with a micro film reader, in which copying apparatus T, a pressing device for pressing transfer material against a photoconductive surface of a photoreceptor plate according to the present invention is incorporated.

The apparatus housing 1 of a rectangular box-like configuration having side walls, a top wall, a bottom plate a rear wall and a front wall generally includes therein a projection unit 2 for projecting a micro film image and a copying unit 12 for reproducing the micro film image on a transfer material.

The projection unit 2 further comprises a light source 3 disposed at the front lower portion of the housing 1, a condenser lens 4 and a projection lens 5 provided adjacent to and above the light source 3, with a pair of guide plates $g_1$ and $g_2$ slightly spaced from each other being disposed between the lenses 4 and 5 for insertion of a micro film 9 therebetween, and a total reflection mirror 6 fixedly provided in the front upper portion of the housing 1 in a position immediately above the light source 3 and the lenses 4 and 5 and suitably inclined to direct the light image of the micro film to a stationary half mirror 7 which is disposed in the central portion of the housing T and is so inclined as to reflect most of the light image to a screen plate 8 fitted in an corresponding opening formed in the front wall of the apparatus housing 1 and to transmit part of the light image toward a photoconductive layer of a photoreceptor plate 14 mentioned later.

Accordingly, the micro film 9 inserted between the condenser lens 4 and the projection lens 5 into the space between the guide plates $g_1$ and $g_2$ is illuminated by the light source 3 through the condenser lens 4, and the light image of the micro film 9 is reflected, through the projection lens 5, by the mirrors 6 and 7 and projected onto the screen plate 8 on an enlarged scale, while part of the same light image is projected onto the photoreceptor 14 through the half mirror 7, in which case, it is to be noted that an erected image of the micro film 9 is projected onto the photoreceptor plate 14, whereas, although a reversed image of the same is projected on the back surface of the screen plate 8 facing the half mirror 7, a normal erected image thereof is seen when an operator observes the screen plate 8 facing the front of the apparatus T in FIG. 2. At the reverse surfaces of the half mirror 7 and the screen plate 8, polarizing plates 10 and 11 are respectively disposed with the optical axes thereof adapted to differ from each other by 90°, so that the photoreceptor plate 14 is shielded from the outside light incident upon the screen plate 8, with the light image which passes through the half mirror 7 being projected onto the plate 14 irrespective of the presence of the polarizing plate 10, while the light image reflected by the half mirror 7 forms the image of the micro film 9 on the screen plate 8 without being influenced by the presence of the polarizing plate 11. It should be noted that the polarizing plate 11 described as disposed at the back of the screen plate 8 may be disposed at the front surface of the plate 8, in which case, the image formed on the plate 8 can be watched more easily, since the plate 11 shields the reflection of the outside light.

The copying unit 12 includes an image forming portion E disposed at the left hand portion of the apparatus housing 1 of FIG. 2 in a position facing the half mirror 7 for receiving the light image through the mirror 7, a developing device 34 provided, at the front lower portion of the housing 1, adjacent to the image forming portion E for developing the electrostatic latent image of the original micro film 9 formed on the copy paper sheet into a visible toner image, and a fixing device 45 similarly disposed at the front lower portion of the housing 1, subsequent to the developing device 34 for fixing the toner image onto the copy paper sheet, each of which devices E, 34 and 45 is arranged in sequence according to the proceeding of the copying process. The image forming portion E further includes a transfer material pressing device 13 comprising the photoconductive or photoreceptor plate 14 which is composed of a transparent electrode formed on a light transmitting base plate such as glass with a photoconductive layer further formed on the transparent electrode, and which is suitably secured to a frame (not shown) of the apparatus housing 1, a pressing electrode plate 15 which has an electrically conductive elastic pressure pad 16 over the entire surface thereof facing the photoreceptor plate 14 and which is pivotally connected at one edge portion 17 thereof to a frame (not shown) of the apparatus housing 1 in a position below and adjacent to the photoreceptor plate 14, and a control device 20 for pressing the conductive elastic pressure pad 16 of the electrode plate 15 against the photoreceptor plate 14 with the copy paper sheet held therebetween or for releasing the same pad 16 from the plate 14 so as to permit the copy paper sheet to pass therethrough, which pressing control device 20 is driven through driving mechanisms described later.

Figure 3:
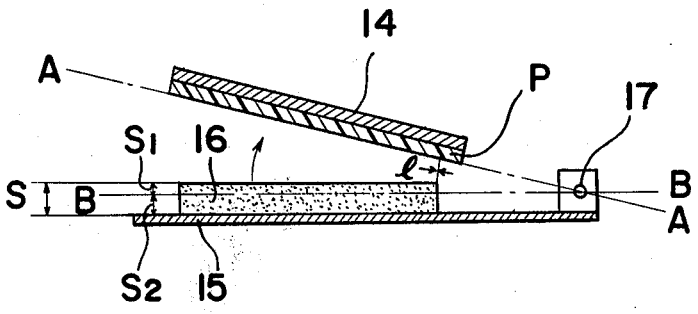
FIG. 3 is a schematic showing, on an enlarged scale, the principle of operation of a transfer material pressing device employed in the apparatus of FIG. 1.

Referring also to FIG. 3 showing the principle of the operations of the transfer material passing device 13 described above, the web of copy paper 28 of electrically insulating nature drawn off a spool 29 is fed between the photoconductive layer P of the photoreceptor 14 and the conductive elastic pressure pad 16 of the pressing electrode plate 15 which is subsequently rotated about the pivotal point 17 in the direction shown by an arrow in FIG. 3 by the control device 20 for pressing the web of copy paper 28 against the layer P of the photoconductor 14 through the pressure pad 16. Upon termination of pressing, a power source (not shown) is turned on for applying potential between the photoconductive layer P of the photoreceptor plate 14 and the conductive elastic pressure pad 16 of the pressing electrode plate 15, which applied potential causes the static charge in the photoconductive layer P of the photoreceptor plate 14 to be moved onto the surface of the copy paper 28. After the potential has been impressed therebetween for a predetermined period of time, the power source (not shown) is turned off with simultaneous separation of pressure pad 16 and the pressing electrode plate 15 from the photoreceptor plate 14 and with consequent separation of the copy paper 28 from the plate 14 for termination of one electrostatic transfer operation. When the pressing electrode plate 15 reaches a sufficient distance away from the photoreceptor plate 14, the web of copy paper after transfer is further transported, cut to a predetermined length by cutter means 51 and 52 (FIG. 2) and subsequently transferred into the developing device 34 for development.

Referring particularly to FIG. 3, the conductive elastic pressure pad 16 to be pressed against the photoreceptor plate 14 through the rotation of the pressure plate 15 is turned about the pivotal axis 17 in the direction of the arrow and initially contacts the photoconductive surface P of the photoreceptor plate 14 somewhat slantwise, subsequently the pressure pad 16 being gradually compressed from its one edge portion adjacent to the pivotal axis 17 toward the other edge thereof as the same is pressed against the photoreceptor plate 14, in which case, air contained between the pad 16 and the photoreceptor plate 14 is positively driven out since the pressure pad 16 contacts the photoreceptor surface 14 by degrees with consequent improvement in the close contact therebetween. On the assumption that the original thickness of the pad 16 is represented by S with the amount of contraction thereof represented by $S_1$ and the thickness of the pad 16 during pressing against the photoreceptor plate 14 is shown by $S_2$ as in FIG. 3, it is to be noted that the pivotal axis 17 of the pressure plate 15 is disposed at the point where the extension A—A of the photoconductive surface P of the photoreceptor plate 14 and the extension B—B of the compressed surface of the pressure pad 16 intersect each other, by which arrangement, the surface of the photoconductive layer P of the photoreceptor plate 14 and the surface of the copy paper 28 is brought into contact with each other under uniform pressure along the entire surfaces thereof since the amount of contraction $S_1$ of the pressure pad 16 is equal at each portion of the pad 16, and furthermore, lag or slippage *l* resulting from parallel displacement of the pressure pad 16 at the photoconductive surface *p* due to the contraction of the pad 16 is almost eliminated.

According to a series of experiments carried out by the present inventors, when the original thickness S of the pad 16 is 10 mm, the amount of contraction $S_1$ of the pad 16 is 3 mm and the distance between the pivotal point 17 and the corresponding edge of the pad 16 is 55 mm in the pressing device 13 of FIG. 3, the slippage *l* of the pressure pad 16 is only 0.08 mm, whereas should the pivotal axis be, for example, at the left-hand side and above the intersecting point 17 in a position 30 mm away from the intersecting point 17 of FIG. 3, the slippage *l* of the pressure pad 16 is increased up to 1.75 mm. Similarly, when the pivotal axis was moved to the left-hand side and somewhat below the intersecting point 17 of FIG. 3, the slippage *l* of the pad 16 was found to be much larger than that in FIG. 3 wherein the pivotal axis coincides with the intersecting point 17, consequently resulting in the damage to the surface of the photoreceptor plate 14 due to frictional contact of the pad 16 with the plate 14.

As is clear from the foregoing description, according to the transfer material pressing device 13 of the invention, since the pivotal axis of the pressure plate 15 is disposed in a position where the extension of the photoconductive surface P of the photoreceptor plate 14 and the extension of the compressed surface of the pressure pad 16 intersect each other, no air is contained among the pad 16, the copy paper sheet and the photoreceptor plate 14, with the copy paper sheet being pressed against the surface of the photoreceptor plate 14 under uniform pressure over the entire surface thereof, while the slippage or lag due to compression of the pressure pad 16 is almost negligible, and consequently, damage to the surface of the photoreceptor plate 14 due to friction during the slippage is advantageously prevented.

Referring back to FIG. 2, at the other edge portion of the pressing plate 15 which is pivotally supported, at one edge portion thereof, at the pivotal axis 17 as described above, there is rotatably provided a roller 19*a* on a bracket 18, with a corresponding roller 19*b* also rotatably provided on a frame (not shown) of the apparatus housing 1 for drawing in the leading edge of the web of copy paper 28 from the spool 29, while, close to the lower edge of the photoreceptor plate 14, a roller 33*b* and a corresponding roller 33*a* are rotatably supported by a frame (not shown) of the housing 1, for transporting the copy paper, the roller 33*a* being urged against the roller 33*b* by spring means (not shown).

Figure 6:
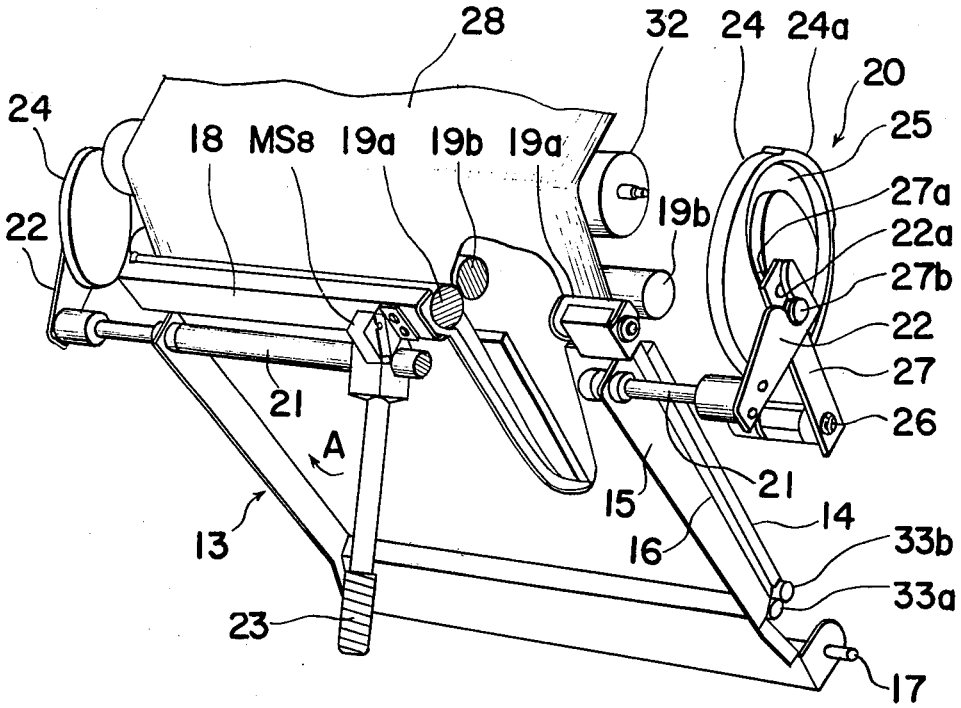
FIG. 6 is a perspective view, partly in section, showing construction of the pressing control device of FIGS. 4 and 5.

Referring also to FIGS. 4 to 6, there is shown the pressing control device 20 for pressing the electrode plate 15 against or releasing the same from the photoreceptor plate 14.

It should be noted that the pressing control device 20 includes a pair of levers 22, cam plates 24, and rocking plates 27 disposed at opposite side edges of the photoreceptor plate 14 and the pressing plate 15 as shown in FIG. 6.

The pressing control device 20 includes, at each side of the photoreceptor plate 14 and the pressing plate 15, a lever 22 which has a notch 22*a* therein and is pivoted to the end portion of the plate 15 by a shaft 21 in a position adjacent to the edge of the plate 15 facing the roller 19*a*, and a cam plate 24 for operating the lever 22 through a rocking plate 27 which is pivotally connected, at one end thereof, to a frame (not shown) of the apparatus housing 1 by a pin 26 and which is provided with a pin 27*a* extending outwardly at right angles from the plate 27 in a position adjacent to the other end of the plate 27, said pin 27*a* being slidably, movably received in a groove 25 formed in the cam plate 24 to follow the profile of the cam groove 25. The rocking plate 27 is further provided in a position adjacent to the pin 27*a*, with another pin 27*b* extending outwardly at right angles from the surface of the plate 27 in a direction opposite to that of the pin 27*a*, which pin 27*b* is adapted to be selectively engaged with and released from the notch 22*a* of the lever 22 by pivoting a releasing lever 23 fixed to the central portion of the shaft 21 for the levers 22.

The roll of the copy paper 28 of electrically insulating nature mounted on the spool 29 rotatably supported by a frame (not shown) of the apparatus housing is held against rotation by a member 30 provided adjacent to the spool 29 and suitably urged toward the outer periphery of the same. The web of copy paper 28 drawn off the spool 29 and fed between the rollers 19*a* and 19*b* is tightened by a tension roller 32 urged upwardly by a spring 31 stretched between a shaft of the roller 32 and a pin fixed to a frame (not shown) of the apparatus housing.

For loading the transfer material pressing device 13 with the copy paper 28, the releasing lever 23 is manually turned in a direction shown by an arrow A in FIG. 5 with consequent pivotal movement of each lever 22 about the shaft 21 for releasing the pin 27*b* of each rocking lever 27 from the notch 22*a* of the corresponding lever 22, and for rendering the pressing plate 15 freely pivotable about the axis 17, in which state, when the pressing plate 15 is rotated downward in the direction of the arrow B in FIG. 5, the conductive pressure pad 16 is released from the photoreceptor plate 14, with the rollers 19*a* also being separated from the corresponding rollers 19*b*. Subsequently, the web of the copy paper 28 is drawn from the paper roll on the spool 29 for being directed over the tension roller 32 and the feeding roller 19*b*, with the leading edge of the web of the same being positioned between the rollers 33*a* and 33*b*. In the next step, the pressing plate 15 is turned upward about the axis 17, with the lever 23 rotated counterclockwise to bring the pin 27*b* of each rocking lever 27 into engagement with the notch 22*a* of the corresponding lever 22, thus the copy paper 28 being tightly held between the pressure pad 16 and the photoreceptor plate 14. It should be noted here that, since the roller 33*a* contacts the roller 33*b* for holding the leading edge of the copy paper 28 therebetween prior to pressure contact of the pressure pad 16 with the photoreceptor plate 14, with the copy paper web 28 being kept perfectly flat through friction between the spool 29 and the pressing member 30, and through proper tension imparted by the roller 32, while the pressure pad 16 is gradually pressed against the photoreceptor 14 from the lower edge portion of the former, there is no possibility that any air bubbles will be formed between the contact surfaces of the pad 16 and the plate 14 which hold the copy paper web 28 therebetween.

Upon projection of the light image of the micro film 9 onto the photoreceptor plate 14 through illumination by the light source 3, with the copy paper 28 held between the pad 16 and the plate 14 and with predetermined potential being applied between the same pad 16 and plate 14, the electrostatic latent image of the micro film 9 is formed on the copy paper 28. When the exposure is completed as described above, the cam plate 24 is rotated through the driving mechanisms mentioned later, and consequently the locking plates 27 the pins 27*a* of which are engaged with the cam grooves 25 of the cam plates 24 turn counterclockwise about the pivotal axis 26 thereof, with the levers 22 pivoted clockwise about the shaft 21, thus the pressing plate 15 being turned downward about the axis 17 so as to release the pressing of the copy paper 28 against the photoreceptor plate 14 for permitting the copy paper 28 to be further transported into subsequent processing devices.

Referring now to FIGS. 7 and 10, there is shown a modification of the pressing control device 20 of FIGS. 4 to 6. In this modification, the cam mechanism described as employed in the device of FIGS. 4 to 6. In this modification, the cam mechanism described as employed in the device of FIGS. 4 to 6 is replaced by a crank and slider mechanism. The pressing control device 120 for pressing the pressure plate 15 against or releasing the same from the photoreceptor plate 14 includes, at each side of the plates 14 and 15, a lever 122 which is secured, at the lower end thereof, to a shaft 121 rotatably mounted on the plate 15 adjacent to the edge thereof facing the roller 19*a*, while the upper end of the lever 122 is pivotally connected to a rocking member 127 by a pin 127*p* mounted on the lever 122. The rocking member 127 pivotally connected, at one end thereof, to a frame (not shown) of the apparatus housing T by a pin 126 is further provided with a link member $\kappa$ which is suitably secured adjacent and in spaced relation to the back surface of the member 127 in a direction parallel to the axis of the same member 127 as shown in FIG. 9, while a slider member *sl*, which is rotatably mounted on a rotary crank disk member 124 at a point adjacent to the outer periphery of said member 124 through a pin $sl_1$, slidably engages the link member $\kappa$. The crank member 124 is adapted to be rotated by a motor m disposed in the apparatus housing through a plurality of gears ge and a chain V in a manner described later.

FIGS. 8(*a*) to 8(*c*) illustrate movements of the pressure plate 15 associated with the rotation of the crank member 124 through the lever 122, while FIG. 10 shows the relation between the movements of the pressure plate 15 and operations of the copying apparatus such as copy paper feeding and voltage impression. Before the copying operation is commenced, the copy paper is tightly held between the photoreceptor plate 14 and the pressing plate 15 through the pressure pad 16 on the plate 15, in which state, the position of the slider member *sl* on the crank member 124 is represented by A in FIG. 10 (the same as the state shown in FIGS. 7).

Upon turning on a print button (not shown), the driving motor *m* rotates the crank member 124 clockwise through the gears *ge* and the chain V moving in a direction shown by an arrow in FIG. 7. When the slider member *sl* reaches a position B (FIG. 10) wherein the copy paper is sufficiently pressed against the photoreceptor plate 14 by the pressing plate 15, and subsequently a position C (FIG. 10) for impressing voltage between the plate 14 and the electrode pressure pad 16 (equivalent to the state shown in FIG. 8(*a*)), a microswitch MSA is turned on by contacting an actuator V*b* fixed on the chain V for impressing d.c. voltage between the photoreceptor 14 and the electrode pressure pad 16 until the slider member *sl* reaches a point D in FIG. 10, i.e., during the period wherein the microswitch MSA is being actuated by the actuator V*b* of the chain V, in which case, the electrostatic latent image of the original is formed on the photoreceptor surface 14 which is continuously exposed to the image rays. The slider member *sl* further reaches a point F through a point E, at which point F, the pressing operation by the pressing plate 15 is finished. When the slider *sl* reaches a point G (equivalent to the position of FIG. 8(*b*)), the pressing plate 15 is fully spaced away from the photoreceptor plate 14, in which state, a copy paper feeding gear *ge'* is rotated by engaging a double chain portion Va of the chain V for rotating the paper feed rollers 33*a* and 33*b* to commence feeding of the copy paper, while the pressing plate 15 is kept spaced away from the photoreceptor plate 14 until the copy paper of a predetermined length has been fed between the two plates 14 and 15. Upon termination of the copy paper feeding at a point H of FIG. 10 (equivalent to the state shown in FIG. 8(*c*), a microswitch MSB is simultaneously turned on by contacting the actuator V*b* of the chain V for actuating the cutters 151 and 152 so as to cut the copy paper to the predetermined length, while the copy paper sheet on which the latent image is formed during the previous process is fed into subsequent processing devices, such as the developing device and fixing device described more in detail later, during which period, the chain V continues to move, with the pressing plate 15 gradually approaching the photoreceptor plate 14 and with the elastic electrode pressure pad 16 being pressed by degrees from its edge portion against the plate 14 from a point I. When the slider *sl* has returned to the original A position, a microswitch MSC is turned on by the actuator V*b* of the chain V for stopping the motor *m* so as to complete one copying cycle. In FIG. 10, chain lines X—X, X'—X' and X''—X'' intersecting at a point $\beta$ show the directions of the link member $\kappa$ in FIGS. 8(*a*) to 8(*c*) respectively, and an arc Y shown in a dotted line denotes the path of the movement of the pin 127*p*, while the circle Z in a full line shows the path of movement of the slider member *sl*.

As is seen from the drawings, the pressing plate 15 is kept pressed against the photoreceptor plate 14 with a sufficient pressure and for a required period of time during the voltage impression therebetween, while during the period of copy paper feeding, the plate 15 is spaced from the photoreceptor plate 14 a sufficient distance and time for passing the copy paper therebetween. In the meantime, one revolution of the crank member 124 by the chain V completes one copying cycle, but the crank member 124 and the chain V are only rotating and moving at predetermined rates, with the movement of the pressing plate 15 being associated with the copying operation through the microswitch actuator V*b* and the double chain portion V*a* of the chain V.

As is clear from the above description, in the pressing control device 120 of the modification of FIGS. 7 to 10, the slider crank mechanism is employed for pressing the pressing plate 15 against or spacing the same away from the photoreceptor plate 14, with the slider crank mechanism being associated, in the movement thereof, with the copying operations, so that the copy paper is tightly held between the pressing plate 15 and the photoreceptor plate 14 uniformly with sufficient pressure through the pressure pad 16 during the voltage impression therebetween, while, during the copy paper feeding, the plate 15 is spaced from the photoreceptor plate 14 for sufficient time and with a sufficient distance between the plates 14 and 15 through the slider crank mechanism having a construction which functions positively and accurately for efficient copying operation.

Referring to FIG. 11, there is shown another modification 120' of the pressing control device 120 of FIGS. 8(*a*) to 10. In this modification, the lever 122 described as pivotally connected to the rocking member 127 by the pin 127*p* of the latter in the device of FIGS. 8(*a*) to 10 is replaced by a lever 122' having a notch 122'*a* formed therein, which notch 122'*a* is adapted to engage the pin 127'*p* of the rocking member 127' in the same manner as in the notch 22*a* and the pin 27*b* of the device of FIGS. 2 to 6, with the releasing lever 23 being fixed to the shaft 121 of the lever 122'. Other construction and function of the pressing control device 120' of the modification of FIG. 11 is similar to those described with reference to FIGS. 2 to 11, so that the description thereof is abbreviated for brevity.

It should be noted here that the pressing control device 20, 120 or 120' described as disposed in pairs at the opposite side edges of the photoreceptor plate 14 and the pressing electrode plate 15 in FIGS. 2, 7 or 11 need not necessarily be in pairs, but may be a single device disposed at either one of the side edges of the plates 14 and 15 so far as the same serves the purpose of the invention.

Referring back to FIG. 2, upon releasing of the pressing plate 15 as described above, the copy paper 28 is further fed into the developing device 34 described below through the rollers 33*a* and 33*b*, and the feeding rollers 44*a* and 44*b*.

The developing device 34 includes a pair of feeding rollers 35*a* and 35*b*, a tank 36 for developing solution in which two pairs of developing rollers 37*a* and 37*b* and 38*a* and 38*b* are rotatably provided, a pair of squeezing rollers 39*a* and 39*b*, two pairs of absorbing rollers 40*a* and 40*b* and 41*a* and 41*b*, and a pump 43 provided with a developing solution feeding plate 42 disposed therebelow, which pump 43 and plate 42 are provided adjacent to and above the developing rollers 37*b* and 38*b*, and the feeding plate 42 should preferably be formed with grooves therein for efficient feeding of the developing solution from the pump 43 into the tank 36. The copy paper web 28 bearing the latent image formed thereon is fed into the developing device 34 through the feeding rollers 44*a* and 44*b*, and further transported through the rollers 35*a* and 35*b*, the developing rollers 37*a* and 37*b*, and 38*a* and 38*b*, while fresh developing solution is continuously fed onto the copy paper sheet 28 from the pump 43 through the plate 42 for developing the latent image on the copy paper 28 into a visible toner image with the pump 43 being driven by a motor $M_3$ described later in connection with FIG. 14. The copy paper 28 thus developed is squeezed by the squeezing rollers 39*a* and 39*b* to remove the developing solution and further passed between the absorbing rollers 40*a* and 40*b*, and 41*a* and 41*b* to remove remaining solution therefrom, and subsequently fed into the fixing device 45.

Referring to FIGS. 2, 12 and 13, there is shown the fixing device 45 of the invention which includes a housing 45*a* having a rectangular box-like configuration made of heat insulating material such as glass-wool or asbestos, with the inner surfaces of the housing 45*a* being lined with heat reflecting plates *r* of aluminum or aluminum plated steel, while elongated slots or openings $O_1$ and $O_2$ extending the width of the copy paper 28 are formed in the opposite rear and front walls of the housing 45*a*. The copy paper sheet 28 from which the developing solution is removed to a certain extent by the rollers 40*a* and 40*b* and 41*a* and 41*b* is fed from the opening $O_1$ into the housing 45*a* and discharged therefrom through the opening $O_2$. In the housing 45*a* lined with the heat reflecting plates *r*, a fixing roller 48*a* and a heat roller 48*b* of metallic material arranged in parallel to and contacting each other are rotatably supported, in a direction normal to the path of the advancing copy paper sheet 28, by side walls of the housing 45*a* through suitable shaft members (not shown), with the fixing roller 48*a* adapted to contact the heat roller 48*b* due to its own weight for being rotated by the rotation of the heat roller 48*b*. In the vicinity of the heat roller 48*b*, there are provided a main heater 47*b* and an auxiliary heater 47*a* for heating the roller 48*b* through a special circuit which will be described later with reference to FIG. 20 to say the heaters 47*a* and 47*b* may be enclosed in the heat roller 48*b* as shown by dotted line circles in FIG. 13.

Heat resistant brush bristles of synthetic fibers such as nylon and polyester or of natural fibers such as pure wool and cotton are secured to the entire outer periphery of the metallic fixing rollers 48*a*, while the heat roller 48*b* is composed of aluminum or copper suitably blackened for improving heat-resistance and heat-conductivity.

In the above arrangement, when the heat roller 48*b* is rotated clockwise through driving means described later, the fixing roller 48*a* contacting the outer periphery of the heat roller 48*b* under pressure due to its own weight through the brush bristles f is rotated counterclockwise for further transporting the copy paper sheet 28 held therebetween, in which case, although the back surface of the copy paper sheet 28 is heated up to approximately 120° C by the heat roller 48*b* with the temperature of the fixing roller 48*a* being also raised up to high level in the range of 80° to 90° C, unbalance in heat radiation is advantageously prevented, since the surface of the copy paper sheet 28 bearing the toner image thereon initially contacts the brush bristles *f* on the fixing roller 48*a* and is gradually heated as the same in further pressed against the heat roller 48*b* after the heat has been radiated through the spaces among the brush bristles *f*.

It should be noted that, since the toner image-carrying surface of the copy paper sheet 28 contacts the brush bristles *f* at small contact area, there is no risk that the liquid film on the toner image-carrying portion will be rubbed off by the bristles *f*, and thus the toner image *m* is definitely fixed on the copy paper sheet 28 without any turbulence or disorder.

As is seen from the foregoing description, the fixing device of the invention composed mainly of the fixing roller 48*a* and the heat roller 48*b* is simple in construction and compact in size with high thermal efficiency due to incorporation of the heat source within the housing 45*a*. Furthermore, provision of the brush bristles f on the outer periphery of the fixing roller 48*a* is effective for better thermal radiation in spite of the use of the rollers for heating the copy paper sheet, and turbulence or disorder of the fixed image can advantageously prevented through gradual heating of the copy paper sheet and the minimum rubbing againt the liquid film on the copy paper sheet during fixing.

Referring also to FIG. 14, it is to be noted that the developing device 34 and the fixing device 45 are formed into independent units respectively, and releasably disposed in the front lower portion of the apparatus housing 1 for facilitating toner replenishment and maintenance of the devices 34 and 45 such as cleaning or replacement of various parts.

The developing device 34 is guided by guide members 49 provided in the lower part of the apparatus housing 1 in a direction parallel to the front wall of the apparatus T for insertion or withdrawal of the same, while the fixing device 45 is also guided by guide members 50 provided in the same lower part of the housing 1 in positions adjacent to opposite side walls of the housing 1, and disposed in such a manner that the elongated front opening $O_2$ thereof is aligned with a corresponding discharge opening 1a formed in the front wall of the housing 1 as seen in FIG. 14.

Referring also to FIGS. 15 to 18, driving systems for the operations of the pressing control device 20, the developing device 34 and the fixing device 45 are described hereinbelow. In FIG. 16, there is fixedly mounted a sprocket 53 on a driving shaft of a driving motor $M_4$ disposed at the lower portion of the copying apparatus housing (not shown), while an endless chain 60 having an auxiliary chain 60*a* and an actuator 60*b* secured thereto is directed around the sprocket 53, and sprockets 54, 55, 56, 57, 58 and 59 rotatably disposed in the manner as described below. The sprocket 54 is fixedly mounted at one end of the shaft of the feeding roller 44*a* (FIG. 4) for driving said roller 44*a*, while the sprocket 55 is rotatably mounted at one end of the shaft of the drawing roller 33*b* (FIG. 4), on which latter shaft a sprocket 55*a* is also mounted through a bearing 65 rotatable only in the direction shown by an arrow C in FIG. 18. The sprocket 55*a* is adapted to engage the auxiliary chain 60*a* attached to the double chain portion of the chain 60. The idle sprockets 57, 58 and 59 are rotatably disposed in such positions as to change direction of movement of the chain 60, with the sprocket 57 provided with spring means (not shown) for imparting tension to the chain 60. The sprocket 56 is intended to drive the cam plate 24 in such a manner that a gear 61 (FIG. 15) secured on the same shaft as the sprocket 56 engages a gear 62, while a gear 63 secured on the same shaft as the gear 62 is in mesh with a gear 64 which is fixedly mounted on the same shaft as the cam plate 24, thus the sprocket 56 driving the cam plate 24 through the gears 61, 62, 63 and 64 with the rotational speed of the former being reduced.

When the sprocket 53 is rotated in the direction shown by an arrow C in FIG. 16 through rotation of the main motor $M_4$, the chain 60 together with the auxiliary chain 60a attached thereto starts moving in the direction shown by arrows C′ from the position shown in the same FIG. 16, in which case, the sprockets 54 to 59 other than the sprocket 55*a*, are driven and consequently, the rotational force is transmitted to the cam plate 24 from the sprocket 56 through the gears 61 to 64. The rotation of the cam plate 24 causes the pressing plate 15 to pivot downward about the pivotal point 17 in the direction of the arrow B in FIG. 2 for releasing the copy paper 28 from the photoreceptor plate 14. Upon releasing of the copy paper 28 by the pressing plate 15, the leading edge of the auxiliary chain 60*a* is brought into engagement with the sprocket 55*a* for rotating the latter. The sprocket 55*a* thus rotated drives the drawing roller 33*b* together with the roller 33*a* which contacts the roller 33*b* under pressure, so that the copy paper 28 positioned between the photoreceptor plate 14 and the pressure pad 16 is further fed toward the developing device 34.

Following the further movement of the chain 60 together with the auxiliary chain 60*a* thereof, the trailing end of the auxiliary chain 60*a* disengages from the sprocket 55*a*, and after the copy paper 28 has been transported a predetermined distance until the leading edge of the copy paper 28 reaches the feeding rollers 44*a* and 44*b*, the driving of the sprocket 55*a* by the auxiliary chain 60*a* terminates. Since the leading edge of the copy paper 28 is transported by the drawing rollers 33*a*and 33*b* and held between the feeding rollers 44*a* and 44*b*, with the roller 44 being driven through the sprocket 54 which is secured on the same shaft as the roller 44*a* and which is rotated by the movement of the chain 60, the roller 44*b* contacting the roller 44*a* under pressure is also rotated and the copy paper 28 is further fed even after the drawing rollers 33*a* and 33*b* stop rotating. It should be noted that each of the rollers 44*a* and 44*b* has a larger diameter than that of the roller 33*a* or 33*b*, while the number of teeth of the sprocket 54 for driving the roller 44*a* is equal to that of the sprocket 55*a* for rotating the roller 33*b*, so that the feeding speed of the rollers 44*a* and 44*b* for the copy paper 28 is higher than that of the drawing rollers 33*a* and 33*b*, by which arrangement, the copy paper 28 is transported in a state suitable for being cut by the cutter blades 51 and 52 without forming any puckering or wrinkle between the rollers 33*a* and 33*b*, and the rollers 44*a* and 44*b*. It is also to be noted that since the sprocket 55*a* is mounted on the shaft of the roller 33*b* through the bearing 65 rotatable only in one direction, the rollers 33*a* and 33*b* are driven at a higher speed than the rotational speed of the sprocket 55*a* which is driven by the auxiliary chain 60*a*, i.e., at a speed corresponding to that of the copy paper transported through the rollers 44*a* and 44*b*.

When the cam plate 24 driven by the sprocket 56 has made one revolution through further movement of the chain 60, the rocking lever 27 and the pressing plate 15 rotates clockwise (FIG. 5) about respective pivotal points 26 and 17 through the movement of the pin 27*a* engaging the cam groove 25 of the cam plate 24 for tightly holding the copy paper 28 between the photoreceptor plate 14 and the pressure pad 16 for a subsequent copying operation, with the pressing plate 15 pressed against the plate 14.

Feeding roller 35*a*, developing rollers 37*a* and 38*a*, and squeezing roller 39*a* for the developing device 34 are each provided with a sprocket (not shown) at the end portion of the corresponding shaft thereof, while a chain (not shown) is directed around each of said sprockets for simultaneous rotation thereof. Furthermore, gears 66 and 67 (FIG. 17) are mounted on the end portions of the shafts of the feeding rollers 35*a* and 35*b* so as to engage each other, the gear 66 being adapted to engage, for simultaneous rotation therewith, a gear 68 secured on the same shaft as the sprocket 54 driven by the chain 60, in which case, rollers 37*b*, 38*b* and 39*b* contacting the corresponding rollers 37*a*, 38*a* and 39*a* are rotated following the rotation of the rollers 37*a*, 38*a* and 39*a* respectively. The gear 66 is adapted to engage the gear 68, when the developing device 34 is guided by the guide members 49 and properly mounted on the apparatus housing 1.

The heat rollers 48*a* and 48*b* for the fixing device 45 are driven by an independent driving motor $M_2$ (FIG. 14) in such a manner that the driving force of the motor $M_2$ is transmitted to the roller 48*b* through a belt 71 directed around a pulley 70 (FIG. 14) secured on the end portion of the same shaft as the roller 48*b* and another pulley 69 fixed on the driving shaft of the motor $M_2$, with the heat roller 48*a* under pressure contact with the roller 48*b* being rotated following rotation of the roller 48*b* through friction therebetween. The provision of the independent motor $M_2$ for driving only the fixing device 45 is intended to permit efficient fixing operation to be effected by maintaining the surfaces of the heat rollers 48*a* and 48*b* in uniformly heated condition through rotation of the rollers 48*a* and 48*b* even when the driving of the transfer material pressing device 13 and the developing device 34 is suspended.

Referring also to FIGS. 19 and 20, the operation of the copying apparatus T of the present invention is controlled by an electrical circuit 72 (FIG.2) incorporated therein.

The circuit 72 generally comprises a first circuit portion 72*a* and a second circuit portion 72*b* coupled to the first circuit portion 72*a* through a transformer $T_2$. The first circuit portion 72*a* further includes a motor $M_1$ for rotating a fan (not shown) to cool the light source 3, the motor $M_2$ for driving the heat rollers 48*a* and 48*b* for the fixing device 45, a pump motor $M_3$ for operating the pump 43 (FIG. 2) to circulate the developing solution and the main motor $M_4$, which motors $M_1$ to $M_4$ are connected in parallel to the power source, a transformer $T_1$ coupled to a lamp $L_1$ for indicating that the apparatus is ready for operation, with the primary winding of the transformer $T_1$ further connected to a triac $TRIAC_1$ and also to series-connected resistance $R_1$, variable resistor $VR_1$ and capacitor $C_2$, with a diac DIAC inserted between the triac $TRIAC_1$ and a junction of the variable resistor $VR_1$ and capacitor $C_2$, a diode rectifier BD coupled to the microswitch $MS_4$ and also to a diode $D_1$ and a cutter driving solenoid CTR, a fixing temperature control circuit 72C mentioned later, and a relay RLYB, while the second circuit portion 72*b* mainly includes a regulator Rg, a relay RLYA, a print switch lamp $L_2$ connected in series to the print switch $S_2$, a high voltage timer circuit 72D including a transistor $Q_2$ whose emitter and collector are connected to a capacitor $C_{10}$ and also to series-connected programmable uni-junction transistor PUT and resistor $R_{13}$, series-connected variable resistor $VR_3$ and resistor $R_{12}$ connected between the collector of the transistor $Q_2$ and a stationary contact of the microswitch $MS_5$, the microswitch $MS_2$, a transistor $Q_3$, a silicon controlled rectifier SCR, and a high voltage power source circuit 72E including a lead relay switch SRR an coupled to the circuit 72D through a variable resistor $VR_4$ and a transformer $T_3$ in a manner as shown in FIG. 19.

Indication signals for causing the circuit 72 to function as required are given through the microswitches $MS_1$, $MS_2$, $MS_4$ and $MS_6$ suitably disposed along the path of the chain 60, and also through microswitch $MS_5$ disposed in such a position as to be actuatable by an actuator or projection 24*a* formed at a portion of the periphery of the cam plate 24 as shown in FIG. 15.

The microswitches $MS_1$, $MS_2$, $MS_4$ and $MS_6$ are adapted to be turned on or off by contacting the actuator or projection 60*b* fixed to a part of the chain 60 as the same chain 60 moves along the path. Before the chain 60 starts moving, the projection 60*b* of the chain 60 depresses the actuator of the microswitch $MS_1$ for keeping the microswitch $MS_1$ turned off, in which state, the main motor $M_4$ is de-energized.

Upon turning on the mainswitch $S_1$ (also shown in FIGS. 1 and 2), the lamp $L_1$ is illuminated to show that the apparatus T is ready for copying operation, while the heater 47*a* connected in parallel to the power source is simultaneously energized for raising the temperature of the fixing device 45, with the temperature control circuit 72C caused to function for controlling the heater 47*b* which is connected in parallel with the heater 47*a*.

More specifically, in FIG. 20, there is shown, on an enlarged scale, a special circuit construction for controlling the fixing temperature according to the present invention. It should be noted that the portion 72C surrounded by a dotted line in FIG. 19 corresponds to the circuit 72C similarly surrounded by a dotted line in the block diagram of FIG. 20. In FIG. 20, the main heater HTR (47*b* in FIG. 13), the auxiliary heater $HTR_1$ (47*a* in FIG. 13) and a control circuit c.c. including a $triac_2$ are energized upon turning on the main switch $S_1$. The control circuit c.c. is connected in series with the main heater HTR (47*b*) for controlling power to be supplied to the later through a temperature sensing element $R_6$ such as a thermistor. The control circuit c.c. mainly includes the $triac_2$ connected in series with the main heater HTR and coupled, through a resistor $R_2$, a diode $D_2$ and a transformer $T_4$, to a hybrid integrated circuit MC1Z for zero crossing switch, to which a capacitor $C_3$ and resistors $R_3$ and $R_4$ are connected. The circuit MC1Z is further coupled to a time instruction modulator OP1 through a collector of a transistor $Q_1$ and a resistor $R_5$, with the emitter of the transistor $Q_1$ connected to the circuit MC1Z through the thermistor $R_6$ and also to the modulator OP1 through a capacitor $C_4$ and a resistor $R_8$. The base of the transistor $Q_1$ is connected to the circuit MC1Z and the modulator OP1 through a variable resistor $VR_2$ and also through series-connected resistor $R_7$ and diode $D_6$ with a capacitor $C_{17}$ connected in parallel with the modulator OP1.

The auxiliary heater $HTR_1$ having a higher heat value than the main heater HTR is provided with a thermoswitch STH connected in series thereto in a similar manner to the temperature sensing element $R_6$ for the main heater HTR, while the heaters HTR and $HTR_1$ are connected in parallel with each other.

Upon turning on the main switch $S_1$, the main heater HTR and the auxiliary heater $HTR_1$ are simultaneously energized for raising the temperature in the fixing device 45. When the temperature in the fixing device 45 has reached a predetermined level, the thermo-switch STH is turned off through detection of the raised temperature for de-energizing the auxiliary heater $HTR_1$. It should be noted that, after the temperature in the fixing device 45 has reached the predetermined level, with the thermo-switch STH thus turned off, only the main heater HTR is controlled in such a manner that if the temperature in the fixing device 45 decreases, the thermistor $R_6$ detects the temperature variation and increases the power supply to the main heater HTR through the conrol circuit c.c. for elevating the temperature or decreases the power supply when the temperature is again raised to the predetermined level, whereby a uniform temperature is maintained in the fixing device 45 with the auxiliary heater $HTR_1$ remaining de-energized.

As is clear from the foregoing description, according to the fixing temperature control circuit 72C of the invention, the main heater HTR is connected in series with the control circuit c.c. which controls the power supply to the main heater HTR through the temperature detecting element $R_6$ for detecting the temperature in the fixing device, while the auxiliary heater $HTR_1$ is connected in series with the thermo-switch STH for de-energizing the auxiliary heater $HTR_1$ upon reaching the predetermined level of the temperature in the fixing device, with the heaters HTR and $HTR_1$ being further connected in parallel with each other, by which arrangement, not only is the time required for the temperature to reach the pre-set level markedly reduced through simultaneous energization of the two heaters $HTR_1$ and HTR, but the auxiliary heater $HTR_1$ controlled by the thermo-switch STH positively functions up to the predetermined temperature level irrespective of the atmospheric temperatures, so that the predetermined temperature of the fixing device is reached without fail upon de-energization of the auxiliary heater $HTR_1$, with the main heater HTR subsequently being controlled for the power supply thereto depending on the temperature variations in the fixing device, thus the temperature in the fixing device being positively maintained at the pre-set level with small variation thereof.

Referring back to FIG. 19, upon turning on the main switch $S_1$, the motor $M_1$ for rotating a fan (not shown) to cool the light source e, and the motor $M_2$ (FIG. 14) for driving the heat rollers 48*a* and 48*b* are also energized for rotation.

Subsequently, when the print switch $S_2$ is turned on, current passing through the microswitch $MS_8$ (FIG. 6) actuated by the releasing lever 23 when the copy paper 28 is positioned in the transfer material pressing device 13 is led to a relay RLYA shown in left lower portion of FIG. 19. Upon turning on the relay RLYA, contacts $SA_1$, $SA_2$, $SA_3$ and $SA_4$ thereof are also turned on respectively, with the contact $SA_1$ switched over for self-retaining the relay RLYA and with the lamp $L_2$ further illuminated for warning against repeated depression of the print switch $S_2$. The turning on of the contact $SA_2$ shown in the upper left portion of the FIG. 19 energizes the pump motor $M_3$ (FIG. 14) for the developing device 34 so as to circulate the developing solution through the pump 43 (FIG. 2), while the contact $SA_3$ turned on, shown in the upper right portion of FIG. 19, causes the main motor $M_4$ (FIGS. 4, 5 and 15) to rotate for driving the chain 60 through the sprocket 53. The contact $SA_4$ shown in the upper right-hand portion of FIG. 19 functions as a change-over switch and is ready for braking the main motor $M_4$ by the application of an inverse voltage through charging of the capacitor $C_6$, while the projection 60*b* secured on the chain 60 driven by the main motor $M_4$ releases the mircoswitch $MS_1$ for turning on the same, which microswitch $MS_1$ thus turned on, together with the contact $SA_3$ of the relay RLYA causes the main motor $M_4$ to be driven for continuous rotation. Subsequently, when the microswitch $MS_2$ is turned on by the projection 60*b* as the chain 60 moves along its path, the thyristor SCR is rendered conducting, with a coil RR of a lead relay switch SRR turned on for applying high voltage between the photoreceptor plate 14 and the pressure pad 16.

Following the conduction of the thyristor SCR, the base potential of the transistor $Q_2$ is decreased, with the emitter and collector of the same transistor $Q_2$ being turned off, and the capacitor $C_{10}$ is caused to be charged for starting the functioning of a high voltage timer circuit portion 72D, in which circuit portion 72D, the transistor $Q_3$ is momentarily rendered conducting after a time constant period determined by the series-connected variable resistor $VR_3$ and resistor $R_{12}$, and a capacitor $C_{10}$, for rendering the SCR non-conducting, with the coil RR and the contact SRR of the lead relay also being turned off, thus consequent turning off of a high voltage circuit portion 72E suspending the high voltage impression across the photoreceptor plate 14 and the electrode pressure pad 16. Subsequently, the increase of the base potential of the transistor $Q_2$ renders the transistor $Q_2$ conducting for short-circuiting the capacitor $C_{10}$ so as to cause the high voltage circuit portion 72D to stop functioning.

Subsequently, before the projection 60*b* of the chain 60 leaves the microswitch $MS_2$ and reaches the microswitch $MS_4$, the actuator 24*a* formed on the outer periphery of the cam plate 24 depresses the microswitch $MS_5$ (FIG. 15) secured on a frame (not shown) of the apparatus to turn the latter switch $MS_5$ off, and consequently to suspend the power supply to the high voltage timer circuit 72D for safety purpose. When the microswitch $MS_4$ is turned on by the contact thereof with the projection 60*b* of the chain 60 as the chain 60 further moves, the solenoid CTR is actuated to drive the cutter blade 52 for cutting the web of the copy paper 28 into the predetermined size. As the cut copy paper sheet 28 is further transported through the rollers 44*a* and 44*b*, the developing device 34 and the fixing device 45, the leading edge of the copy paper sheet 28 with respect to the advancing direction thereof engages and turns on the microswitch $MS_3$ (FIG. 2) disposed in a position immediately before the discharge outlet 1*a* of the apparatus housing T, which microswitch $MS_3$ in turn de-energizes the relay RLYA with the contacts $SA_1$, $SA_2$, $SA_3$ and $SA_4$ thereof being turned off. More specifically, the contact $SA_2$ thus turned off causes the pump motor $M_3$ to stop, while the main motor $M_4$ being driven only through the microswitch $MS_1$ turned on, with the contact $SA_3$ turned off. The contact $SA_4$ is switched over to bring the circuit back to the original condition before the print switch $S_2$ is turned on. Upon turning off of the microswitch $MS_3$ through disengagement of the trailing edge of the copy paper sheet 28, the lamp $L_2$ is de-energized for indicating completion of the copying operation. The microswitch $MS_6$ to be turned on as the projection 60*b* of the chain 60 further moves is disposed in such a position with respect to the microswitch $MS_3$ that a little time before the microswitch $MS_6$ is turned on by the projection 60*b*, the leading edge of the copy paper sheet 28 in the advancing direction thereof has turned on the microswitch $MS_3$, so that if for some reason, for example, due to jamming of the copy paper, the microswitch $MS_6$ should be turned on by the projection 60*b* without the microswitch $MS_3$ having been actuated by the leading edge of the copy paper sheet 28, the relay RLYA remains on, while a relay RLYB is energized through the contact $SA_3$ of the relay RLYA and the microswitch $MS_6$, with the contact $SB_1$ of the relay RLYB turned off and with the contact $SB_2$ thereof turned on so as to energize the coil of the relay RLYB for self-retaining thereof, in which case, the contact $SB_3$ is turned off to de-energize the high voltage power source portion 72E for safety purposes.

As the chain 60 further moves, the actuator 60*b* thereof depresses the actuator of the microswitch $MS_1$ for turning off the latter, by which the main motor $M_4$ is de-energized, with the charge in the capacitor $C_6$ being simultaneously impressed on the main motor $M_4$. In this case, the polarity of the charge applied to the motor $M_4$ is adapted to be opposite in direction to the electrical polarity of the same motor $M_4$ before the de-energization for rapid braking of the motor $M_4$.

For repeating the copying operations, the print button is again turned on for causing the apparatus to function in the manner as in the foregoing description, in which case, should paper jamming of the copy paper 28 take place for some reason or other at some portion of the transfer path as mentioned earlier, the relay RLYA continues to be on, with the lamp $L_2$ for the print switch remaining illuminated. In the above state, even if the print switch $S_2$ is turned on, the main motor $M_4$ is never energized since the contact $SB_1$ of the relay RLYB is turned off, thus any danger due to further aggravation of the accident such as paper jamming or the like being advantageously prevented. Upon turning off the main switch $S_1$, the relay RLYA is re-set back to its original state.

As is clear from the foregoing description, according to the copying apparatus of the invention, the copying paper of electrically insulating nature is pressed against the photoconductive photoreceptor by the pressing plate having the electrode pressure pad thereon, while the photoreceptor plate is exposed to the light image of the original during impression of the predetermined voltage between the photoreceptor plate and the electrode pressure pad for forming the electrostatic latent image on the copying paper, so that a transferred image is obtained through the negative image to positive image processing system, and microfilms of a negative original to be used for the apparatus can be copied into positive images of high quality without the necessity of the reverse development as required in the conventional copying apparatus of the Electro-Fax type. Moreover, since the copy paper can be tightly held preliminarily between the photoreceptor layer and the electrode pressure pad in preparation for the exposure, it is unnecessary to feed the copy paper from the copy paper storage portion to the image forming portion at each copying and the exposure time can also be reduced to a very short period, for example, to several ten milli-seconds thus resulting in marked reduction of time required for the copying operation. Furthermore, since the corona charger, the cleaning device or the like need not be disposed around the image forming portion, the copying apparatus itself can be made compact in size.

Additionally, the adoption of the fixing device which rapidly reaches the predetermined temperature irrespective of the atmospheric temperatures without unbalanced heat radiation contributes much to the prevention of the disorder or disturbance of the copied image.

It is another advantage of the copying apparatus of the invention as applied to a micro film reader and printer that, since the light image of the micro film illuminated by the light source is projected onto the photoreceptor plate through the half mirror, while the same light image reflected by the half mirror is projected onto the screen, with polarizing plates the optical axes of which are adapted to differ from each other by 90° being disposed between the half mirror and the photoreceptor plate and also before or after the screen, the photoreceptor plate is perfectly shielded from any outside light, thus permitting the apparatus to function as a micro film reader and a printer simultaneously. The special construction of the copying apparatus of the invention in which the light image of the micro film illuminated by the light source can constantly be projected onto the photoreceptor plate is made possible by the arrangement that the photoreceptor plate is rendered sensitive to light for forming the latent image on the copy paper only when the voltage is impressed between the photoreceptor plate and the pressure electrode. Accordingly, not only is shielding of the photoreceptor plate against light from the light source unnecessary, but driving means for removing the reflecting mirror from the light path as required in the conventional apparatuses is advantageously eliminated, and thus a micro film reader and printer which is simple in construction and compact in size without any noises during operation is provided for efficient reading and copying of micro films.

Although the present invention has been fully described by way of example with reference to the attached drawings, it is to be noted that various changes and modifications are apparent to those skilled in the art. Therefore, unless such changes and modifications depart from the scope of the present invention, they should be construed as included therein.

What is claimed is:

1. In an electrophotographic copying apparatus in which a photoconductive plate composed of a light transmitting electrode plate and a photoconductive layer disposed thereover is pressed with a pressing electrode plate which has an electrically conductive elastic pressure pad thereon which is compressed when pressed against the photoconductive plate, with a transfer material of an electrically insulating nature between the photoconductive plate and the pressure pad while an image of an original to be copied is projected through said light transmitting electrode plate and a predetermined potential is applied between said light transmitting electrode plate and said pressing electrode plate, the improvement comprising:

mounting means for mounting said pressing electrode plate for pivotal movement about a pivotal axis where an extension of the plane of the surface of said photoconductive layer and an extension of the plane of the surface of said conductive elastic pressure pad in the compressed condition intersect each other; and pressing control means coupled to said pressing electrode plate for pivotally moving said pressing electrode plate for pressing said transfer material against said photoconductive layer and for releasing the same from said photoconductive layer to a position where the surface of said photoconductive layer and the surface of said conductive elastic pressure pad are spaced from each other.

2. The improvement in an electrophotographic copying apparatus as claimed in claim 1, wherein said pressing control means includes:

rotatably driven means, and motion transmitting means coupled between said rotatably driven means and said pressing electrode plate for transmitting the rotation of said rotary means to move said pressing electrode plate in pivotal movement about said pivotal axis for pressing said electrode plate against and releasing it from said photoconductive layer.

3. The improvement in an electrophotographic copying apparatus as claimed in claim 2, wherein said transmitting means includes:

a first member engaged by said rotary means for being rocked by the rotation of said rotary means, and a second member pivotally connected between said first member and said pressing electrode plate for pivotally moving said pressing electode plate by the rocking movement of said first member.

4. In an electrophotographic copying apparatus in which a photoconductive plate composed of a light transmitting electrode plate and a photoconductive layer disposed thereover is pressed with a pressing electrode plate which has an electrically conductive elastic pressure pad thereon which is compressed when pressed against the photoconductive plate, with a transfer material of an electrically insulating nature between the photoconductive plate and the pressure pad while an image of an original to be copied is projected through said light transmitting electrode plate and a predetermined potential is applied between said light transmitting electrode plate and said pressing electrode plate, the improvement comprising:

mounting means for mounting said pressing electrode plate for pivotal movement about a pivotal axis where an extension of the plane of the surface of said photoconductive layer and an extension of the plane of the surface of said conductive elastic pressure pad in the compressed condition intersect each other; and pressing control means coupled to said pressing electrode plate for pivotally moving said pressing electrode plate for pressing said transfer material against said photoconductive layer and for releasing the same from said photoconductive layer to a position where the surface of said photoconductive layer and the surface of said conductive elastic pressure pad are spaced from each other, said pressing control means including:

a drive cam member having a cam groove therein and rotatably disposed for rotation in said apparatus, a rocking member having a first pin member thereon slidably received in said cam groove, one end of said rocking member being pivotally connected on said copying apparatus for pivotal movement, and a second pin member on said rocking member, and a notched member having a notched portion formed therein for engaging said second pin member, one end portion of said notched member being pivotally mounted adjacent one edge portion of said pressing electrode plate remote from said pivotal axis, said pressing electrode plate being driven for pivotal movement about said pivotal axis upon engagement of said second pin member in said notch through movement of said first pin member in said cam groove of said cam member for rocking said rocking member and said notched member.

5. In an electrophotographic copying apparatus in which a photoconductive plate composed of a light transmitting electrode plate and a photoconductive layer disposed thereover is pressed with a pressing electrode plate which has an electrically conductive elastic pressure pad thereon which is compressed when pressed against the photoconductive plate, with a transfer material of an electrically insulating nature between the photoconductive plate and the pressure pad while an image of an original to be copied is projected through said light transmitting electrode plate and a predetermined potential is applied between said light transmitting electrode plate and said pressing electrode plate, the improvement comprising:

mounting means for mounting said pressing electrode plate for pivotal movement about a pivotal axis where an extension of the plane of the surface of said photoconductive layer and an extension of the plane of the surface of said conductive elastic pressure pad in the compressed condition intersect each other; and pressing control means coupled to said pressing electrode plate for pivotally moving said pressing electrode plate for pressing said transfer material against said photoconductive layer and for releasing the same from said photoconductive layer to a position where the surface of said photoconductive layer and the surface of said conductive elastic pressure pad are spaced from each other, said pressing control means including:

a rotatably driven crank disk member having a slider member rotatably mounted adjacent to the outer periphery thereof, a rocking member having a link portion, one end portion of said rocking member being pivotally connected to said copying apparatus for pivotal movement, and a lever member, a pin member pivotally connecting said lever member to said rocking member, a shaft rotatably adjacent to one edge portion of said pressing electrode plate remote from said pivotal axis to which one end of said lever member is fixedly mounted, said slider member on said crank disk member slidably engaging said link portion of said rocking member, said pressing electrode plate being driven for pivotal movement about said pivotal axis through said crank disk member, said slider member, said pin member and said lever member.

6. In an electrophotographic copying apparatus in which a photoconductive plate composed of a light transmitting electrode plate and a photoconductive layer disposed thereover is pressed with a pressing electrode plate which has an electrically conductive elastic pressure pad thereon which is compressed when pressed against the photoconductive plate, with a transfer material of an electrically insulating nature between the photoconductive plate and the pressure pad while an image of an original to be copied is projected through said light transmitting electrode plate and a predetermined potential is applied between said light transmitting electrode plate and said pressing electrode plate, the improvement comprising:

mounting means for mounting said pressing electrode plate for pivotal movement about a pivotal axis where an extension of the plane of the surface of said photoconductive layer and an extension of the plane of the surface of said conductive elastic pressure pad in the compressed condition intersect each other; and pressing control means coupled to said pressing electrode plate for pivotally moving said pressing electrode plate for pressing said transfer material against said photoconductive layer and for releasing the same from said photoconductive layer to a position where the surface of said photoconductive layer and the surface of said conductive elastic pressure pad are spaced from each other, said pressing control means including:

a rotatably driven crank disk member having a slider member rotatably mounted adjacent to the outer periphery thereof, a rocking member having a link portion, one end portion of said rocking member being pivotally connected to said copying apparatus for pivotal movement, said slider member on said crank disk member slidably engaging said link portion of said rocking member, a notched member having a notch therein, a pin member on said rocking member engaged in said notch, a shaft rotatably mounted adjacent to one edge portion of said pressing electrode plate remote from said pivotal axis on which one end of said notched member is fixedly mounted, said pressing electrode plate being driven for pivotal movement about said pivotal axis upon engagement of said pin member in said notch, through said crank disk member, said pin member, said rocking member and said notched member.

* * * * *